US011603502B2

(12) United States Patent
Guay et al.

(10) Patent No.: US 11,603,502 B2
(45) Date of Patent: Mar. 14, 2023

(54) MARINE FUEL COMPOSITIONS

(71) Applicant: EXXONMOBIL TECHNOLOGY AND ENGINEERING COMPANY, Annandale, NJ (US)

(72) Inventors: Lisa M. Guay, Morristown, NJ (US); Kenneth C. H. Kar, Yardley, PA (US); Sheryl B. Rubin-Pitel, Newtown, PA (US)

(73) Assignee: EXXONMOBIL TECHNOLOGY AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 17/454,359

(22) Filed: Nov. 10, 2021

(65) Prior Publication Data

US 2022/0169934 A1 Jun. 2, 2022

Related U.S. Application Data

(60) Provisional application No. 63/119,326, filed on Nov. 30, 2020.

(51) Int. Cl.
*C10L 1/02* (2006.01)
*C10L 10/02* (2006.01)

(52) U.S. Cl.
CPC ..... *C10L 1/026* (2013.01); *C10L 10/02* (2013.01); *C10L 2200/0438* (2013.01); *C10L 2200/0469* (2013.01); *C10L 2270/026* (2013.01); *C10L 2290/24* (2013.01)

(58) Field of Classification Search
CPC .. C10L 10/02; C10L 1/02; C10L 1/026; C10L 2200/0438; C10L 2200/0469; C10L 2270/026; C10L 2290/24; Y02E 50/10; Y02P 30/20
See application file for complete search history.

(56) References Cited

U.S. PATENT DOCUMENTS

| | | | |
|---|---|---|---|
| 5,871,634 | A | 2/1999 | Wiehe et al. |
| 10,899,983 | B1 | 1/2021 | Kar et al. |
| 2012/0246999 | A1 | 10/2012 | Stern et al. |

FOREIGN PATENT DOCUMENTS

| | | | | |
|---|---|---|---|---|
| EP | 0686182 | A1 | 12/1995 | |
| EP | 2302020 | A1 * | 3/2011 | ..... C10L 1/026 |
| EP | 2302020 | A1 | 3/2011 | |
| JP | 2007231119 | A * | 9/2007 | |
| JP | 2007231119 | A | 9/2007 | |

OTHER PUBLICATIONS

JP2007231119A—BIB Translated (Year: 2007).*
JP2007231119A—Claims Translated (Year: 2007).*
JP2007231119A—Description Translated (Year: 2007).*
US EPA Report "A Comprehensive Analysis of Biodiesel Impacts on Exhaust Emissions Draft Technical Report," EPA420P-02-001, Oct. 2002, figure ES-A.
Griffith, M. G. and Siegmund, C. W., "Controlling Compatibility of Residual Fuel Oils," Marine Fuels, ASTM STP 878, C. H. Jones, Ed., American Society for Testing and Materials, Philadelphia, 1985, pp. 227-247.
International Search Report and Written Opinion PCT/US2021/033988 dated Sep. 3, 2021.
"ISO 10307-2", Petroleum products—Total sediment in residual fuel oils—Determination using standard procedures for ageing, pp. 9 (2009).
"Study to evaluate test methods to assess the stability and compatibility of marine fuels in view of the IMO MARPOL Annex VI Regulation 14.1.3 for 2020 Sulphur requirements", Concawe Report, pp. 57 (Nov. 2019).
"Particulate Matter (PM) Basics", EPA, Retrieved from Internet URL : https://www.epa.gov/pm-pollution/particulate-matter-pm-basics#PM, accessed on Oct. 6, 2022, pp. 6.
International Search Report and Written Opinion received for PCT Patent Application No. PCT/US2021/072342, dated Feb. 16, 2022, 11 pages.

* cited by examiner

*Primary Examiner* — Ellen M McAvoy
*Assistant Examiner* — Chantel L Graham
(74) *Attorney, Agent, or Firm* — Shook, Hardy & Bacon L.L.P.

(57) ABSTRACT

Provided are marine fuels or fuel blending compositions, methods of making such fuels or compositions and methods of potentially reducing the life cycle carbon intensity of marine fuels or a fuel blending compositions. The marine fuel or fuel blending composition disclosed herein includes at least 20 vol % of a resid-containing fraction, and from 5 vol % to 80 vol % of one or more renewable fuel blending components. The one or more renewable fuel blending components includes one or more fatty acid alkyl esters. Optionally the one or more renewable fuel blending components may include gas-to-liquid hydrocarbons from renewable synthesis gas, hydrotreated natural fat or oil, hydrotreated waste cooking oil, hydrotreated tall oil, pyrolysis gas oil, or combinations thereof. Optionally, the resulting marine fuel or fuel blending composition can have a BMCI–TE difference value of 15 or less.

30 Claims, 13 Drawing Sheets

| Test | Method | Unit | FO 1 | FO 2 | Dist. 1 | Dist. 2 | Dist. 3 | Dist. 4 | RD 1 | RD 2 |
|---|---|---|---|---|---|---|---|---|---|---|
| Density @ 15°C | D4052 | $g/cm^3$ | 1.010 | 0.9720 | 0.876 | 0.855 | 0.836 | 0.8377 | 0.778 | 0.796 |
| Kinematic Viscosity (KV) @ 40°C | D445 | $mm^2/s$ | | | | | 3.565 | | 2.65 | 3.739 |
| Kinematic Viscosity (KV) @ 50°C | D445 | $mm^2/s$ | 473.0 | 1238 | 9.8531 | 4.2735 | 2.943 | 3.0* | 2.229 | 3.076 |
| CCAI | Calculated | - | 868 | 822 | 793 | 795 | 789 | 790* | 741 | 746 |
| Distillation - Average Boiling Point | D86 | °C | | | | | 287 | | 290 | 305 |
| Distillation - Average Boiling Point | D7169 | °C | | | 381 | 325 | | | | |
| Distillation - Average Boiling Point | AM-S 1847 | °C | | 541 | | | | | | |
| Aromatics | 2DGC | wt% | | | 43.2 | 36.8 | | | | |
| Aromatics | D5186 | wt% | | | | | 21.9 | 16.2* | | |
| Aromatics | EN 12916 | wt% | | | | | | | 0.8 | 5 |
| Sulfur | ISO 8754 | wt% | | 0.58 | | | | | | |
| Carbon Residue, Micro | D4530 | wt% | 19.20 | 11.2 | | | | | | |
| Heptane Insolubles | D3279 | wt% | | 4.3 | | | | | | |
| BMCI | Calculated | - | 83.4 | 63.8 | 32.9 | 29.9 | 26.5 | 27* | -1.7 | 4.5 |
| Toluene Equivalence (TE) | AM-S 79-004 | - | 73 | 41 | 0 | 0 | 0 | 0 | 0 | 0 |
| BMCI - TE | - | - | 10.9 | 22.8 | 32.9 | 29.9 | 26.5 | 27 | -1.7 | 4.5 |
| Oil Compatibility Test | AM-S 1999-011 | | | | | | | | | |
| Solubility blending number ($S_{BN}$) | | - | 100 | | 30* | 30* | 26* | 27* | | |
| Incompatibility number ($I_N$) | | - | 78 | | 0 | 0 | 0 | 0 | | |
| $S_{BN}$ - $I_N$ | | - | 22 | | 30 | 30 | 26 | 27 | | |
| Compatibility - Rofa Test | ASTM D7157 | | | | | | | | | |
| S-value | | - | | 1.74 | | | | | | |
| $S_a$ | | - | | 0.67 | | | | | | |
| $S_0$ | | - | | 0.57 | | | | | | |
| $R^2$ | | - | | 1.00 | | | | | | |
| Solubility blending number ($S_{BN}$) | | - | | 57 | | | | | | |
| Incompatibility number ($I_N$) | | - | | 33 | | | | | | |
| $S_{BN}$ - $I_N$ | | - | | 24 | | | | | | |

*Estimated values

FIG. 1

| | | | FAME1 | FAME2 | FAME3 | FAME4 | FAME5 | FO1 | FO2 | FO3 | FO4 |
|---|---|---|---|---|---|---|---|---|---|---|---|
| Test | Method | Unit | | | | | | | | | |
| Density @ 15°C | D4052 | $g/cm^3$ | 0.881 | 0.882 | 0.875 | 0.881 | 0.877 | 1.010 | 0.972 | 0.963 | 0.987 |
| Kinematic Viscosity (KV) @ 50°C | D445 | $mm^2/s$ | 3.734 | 4.369 | 3.739 | 3.612 | 3.566 | 473.0 | 1238 | 217.3 | 375.5 |
| Distillation - Average Boiling Point | D1160 | °C | 348 | 351 | 341 | 50 | | | | | |
| Distillation - Average Boiling Point | D7169 | °C | | | | | | | | 483 | 492 |
| Distillation - Average Boiling Point | AM-S 1847 | °C | | | | | | | 541 | | |
| CCAI | Calc. | - | 825 | 821 | 819 | 827 | 823 | 868 | 822 | 830 | 848 |
| Sulfur | ISO 8754 | wt% | | | | | | | 0.58 | 0.48 | 0.46 |
| Carbon Residue, Micro | D4530 | wt% | | | | | | 19.20 | 11.2 | 6.16 | 9.84 |
| Asphaltenes | IP 143 | wt% | | | | | | | | 1.8 | 2.9 |
| Heptane Insolubles | D3279 | wt% | | | | | | | 4.3 | | 3.6 |
| BMCI | Calc. | - | 39.1 | 39.4 | 37.3 | 39.9 | 39* | 83.4 | 63.8 | 64.1 | 74.8 |
| Toluene Equivalence (TE) | AM-S 79-004 | - | 0 | 0 | 0 | 0 | 0 | 73 | 41 | 43 | 43 |
| BMCI - TE | - | - | 39.1 | 39.4 | 37.3 | 39.9 | 39 | 10.9 | 22.8 | 21.1 | 31.8 |
| Oil Compatibility Test | AM-S 1999-011 | | | | | | | | | | |
| Solubility blending number ($S_{BN}$) | | - | 89* | | | 68* | | 100 | | 61 | |
| Incompatibility number ($I_N$) | | - | 0 | | | 0 | | 78 | | 38 | |
| $S_{BN}$ - $I_N$ | | - | 89 | | | 68 | | 22 | | 23 | |
| Compatibility - Rofa Test | ASTM D7157 | | | | | | | | | | |
| S-value | | - | | | | | | | 1.74 | 1.82 | 1.93 |
| $S_a$ | | - | | | | | | | 0.67 | 0.66 | 0.59 |
| $S_0$ | | - | | | | | | | 0.57 | 0.63 | 0.8 |
| $R^2$ | | - | | | | | | | 1.00 | 1.000 | 0.998 |
| Solubility blending number ($S_{BN}$) | | - | 68* | 84* | 71* | | 116* | | 57 | 61 | 79 |
| Incompatibility number ($I_N$) | | - | 0 | 0 | 0 | | 0 | | 33 | 34 | 41 |
| $S_{BN}$ - $I_N$ | | - | 68 | 84 | 71 | | 116 | | 24 | 27 | 38 |
| Total Sediment Potential (TSP) | ISO 10307-2 thermal aging | wt% | | | | | | | | 0.01 | <0.01 |
| Spot Test – Cleanliness Rating | D4740 | - | | | | | | | | 1 | |

*Estimated values

FIG. 2

| Test | Method | Unit | FO1 | FO2 | FO3 | 80% FO1 + 20% FAME4 | 80% FO2 + 20% FAME5 | 80% FO3 + 20% FAME1 | 80% FO3 + 20% FAME2 | 80% FO3 + 20% FAME3 |
|---|---|---|---|---|---|---|---|---|---|---|
| Density @ 15°C | D4052 | $g/cm^3$ | 1.010 | 0.972 | 0.963 | 0.969 | 0.9531 | 0.947 | 0.947 | 0.945 |
| Kinematic Viscosity (KV) @ 50°C | D445 | $mm^2/s$ | 473.0 | 1238 | 217.3 | | 144.6 | 57.24 | 56.65 | 57.67 |
| Distillation - Average Boiling Point | D7169 | °C | | | 483 | | | 463 | | |
| Distillation - Average Boiling Point | AM-S 1847 | °C | | 541 | | | | | | |
| Distillation - Average Boiling Point | AM-S 1567 | °C | | | | | 518 | | | |
| CCAI | Calc. | - | 868 | 822 | 830 | 860 | 825 | 831 | 831 | 829 |
| Sulfur | ISO 8754 | wt% | | 0.58 | 0.48 | | 0.47* | 0.39* | 0.39* | 0.39* |
| Carbon Residue, Micro | D4530 | wt% | 19.20 | 11.2 | 6.16 | 15.8* | 9.42 | 5.14 | 5.0* | 5.0* |
| Asphaltenes | IP 143 | wt% | | | 1.8 | | | 1.5* | 1.5* | 1.5* |
| Heptane Insolubles | D3279 | wt% | | 4.3 | | | 3.5* | | | |
| BMCI | Calc. | - | 83.4 | 63.8 | 64.1 | 74.7 | 56.6 | 58.1 | 59.1 | 58.7 |
| Toluene Equivalence (TE) | AM-S 79-004 | - | 73 | 41 | 43 | 73 | 41 | 47 | 47 | 48 |
| BMCI - TE | - | - | 10.9 | 22.8 | 21.1 | 2.2 | 15.6 | 11.1 | 12.1 | 10.7 |
| Oil Compatibility Test | AM-S 1999-011 | | | | | | | | | |
| Solubility blending number ($S_{BN}$) | | - | 100 | | 61 | 112 | | 74 | | |
| Incompatibility number ($I_N$) | | - | 78 | | 38 | 82 | | 38 | | |
| $S_{BN}$ - $I_N$ | | - | 22 | | 23 | 30 | | 36 | | |
| Compatibility - Rofa Test | ASTM D7157 | | | | | | | | | |
| S-value | | - | | 1.74 | 1.82 | | 2.43 | 1.88 | 1.85 | 1.74 |
| $S_a$ | | - | | 0.67 | 0.66 | | 0.66 | 0.66 | 0.64 | 0.64 |
| $S_0$ | | - | | 0.57 | 0.63 | | 0.82 | 0.63 | 0.66 | 0.62 |
| $R^2$ | | - | | 1.00 | 1.000 | | 1.000 | 0.999 | 0.999 | 0.999 |
| Solubility blending number ($S_{BN}$) | | - | | 57 | 61 | | 80 | 62 | 65 | 61 |
| Incompatibility number ($I_N$) | | - | | 33 | 34 | | 34 | 34 | 36 | 36 |
| $S_{BN}$ - $I_N$ | | - | | 24 | 27 | | 46 | 28 | 29 | 25 |
| Total Sediment Potential (TSP) | ISO 10307-2 thermal aging | wt% | | | 0.01 | | 0.01 | <0.01 | <0.01 | <0.01 |
| Spot Test – Cleanliness Rating | D4740 | - | | | 1 | | | 1 | 1 | 1 |

*Estimated values

FIG. 3

| Test | Method | Unit | FO2 | FO4 | 50% FO2 + 50% FAME5 | 50% FO4 + 50% FAME1 | 50% FO4 + 50% FAME2 | 50% FO4 + 50% FAME3 |
|---|---|---|---|---|---|---|---|---|
| Density @ 15°C | D4052 | $g/cm^3$ | 0.972 | 0.987 | 0.9238 | 0.934 | 0.934 | 0.931 |
| Kinematic Viscosity (KV) @ 50°C | D445 | $mm^2/s$ | 1238 | 375.5 | 21.04 | 17.12 | 16.76 | 16.19 |
| Distillation - Average Boiling Point | D7169 | °C | | 492 | | 401 | 383 | 385 |
| Distillation - Average Boiling Point | AM-S 1847 | °C | 541 | | | | | |
| Distillation - Average Boiling Point | AM-S 1567 | °C | | | 457 | | | |
| CCAI | Calc. | - | 822 | 848 | 825 | 839 | 839 | 837 |
| Sulfur | ISO 8754 | wt% | 0.58 | 0.46 | 0.31* | 0.24* | 0.24* | 0.24* |
| Carbon Residue, Micro | D4530 | wt% | 11.2 | 9.84 | 5.97 | 5.2* | 5.2* | 5.2* |
| Asphaltenes | IP 143 | wt% | | 2.9 | | 1.5* | 1.5* | 1.5* |
| Heptane Insolubles | D3279 | wt% | 4.3 | 3.6 | 2.3* | 1.9* | 1.9* | 1.9* |
| BMCI | Calc. | - | 63.8 | 74.8 | 47.8 | 58.3 | 60.1 | 58.5 |
| Toluene Equivalence (TE) | AM-S 79-004 | - | 41 | 43 | 44 | 44 | 46 | 43 |
| BMCI - TE | - | - | 22.8 | 31.8 | 3.8 | 14.3 | 14.1 | 15.5 |
| Compatibility - Rofa Test | ASTM D7157 | | | | | | | |
| S-value | | - | 1.74 | 1.93 | 2.67 | 1.94 | 2.08 | 2 |
| $S_a$ | | - | 0.67 | 0.59 | 0.66 | 0.61 | 0.59 | 0.59 |
| $S_0$ | | - | 0.57 | 0.8 | 0.9 | 0.76 | 0.84 | 0.81 |
| $R^2$ | | - | 1.00 | 0.998 | 0.990 | 0.969 | 0.996 | 1.000 |
| Solubility blending number ($S_{BN}$) | | - | 57 | 79 | 86 | 73 | 82 | 79 |
| Incompatibility number ($I_N$) | | - | 33 | 41 | 34 | 39 | 41 | 41 |
| $S_{BN}$ - $I_N$ | | - | 24 | 38 | 52 | 34 | 41 | 38 |
| Total Sediment Potential (TSP) | ISO 10307-2 thermal aging | wt% | | <0.01 | <0.01 | 0.01 | <0.01 | 0.01 |

FIG. 4

| Test | Method | Unit | FO2 | FO3 | 30% FO2 + 30% D4 + 40% FAME5* | 40% FO2 + 20% RD1 + 40% FAME5* | 75% FO3 + 25% D1* | 75% FO3 + 10% FAME1 + 15% D1* | 50% FO3 + 50% D1* | 50% FO3 + 30% FAME1 + 20% D1* |
|---|---|---|---|---|---|---|---|---|---|---|
| Density @ 15°C | D4052 | $g/cm^3$ | 0.972 | 0.963 | 0.894 | 0.896 | 0.941 | 0.942 | 0.919 | 0.921 |
| Kinematic Viscosity (KV) @ 50°C | D445 | $mm^2/s$ | 1238 | 217.3 | 9.21 | 13.02 | 79.50 | 65.60 | 34.77 | 21.99 |
| CCAI | Calc. | - | 822 | 830 | 812 | 806 | 821 | 824 | 811 | 821 |
| Sulfur | ISO 8754 | wt% | 0.58 | 0.48 | 0.19 | 0.25 | 0.37 | 0.37 | 0.25 | 0.25 |
| Carbon Residue, Micro | D4530 | wt% | 11.2 | 6.16 | 3.7 | 4.9 | 4.7 | 4.7 | 3.2 | 3.2 |
| Asphaltenes | IP 143 | wt% | | 1.8 | | | 1.4 | 1.4 | 0.9 | 0.9 |
| Heptane Insolubles | D3279 | wt% | 4.3 | | 1.4 | 1.9 | | | | |
| BMCI | Calc. | - | 63.8 | 64.1 | 44.3 | 41.2 | 56.3 | 56.9 | 48.5 | 50.3 |
| Toluene Equivalence (TE) | AM-S 79-004 | - | 41 | 43 | 41 | 41 | 43 | 43 | 43 | 43 |
| BMCI - TE | - | - | 22.8 | 21.1 | 3.3 | 0.2 | 13.3 | 13.9 | 5.5 | 7.3 |
| Oil Compatibility Test | AM-S 1999-011 | | | | | | | | | |
| Solubility blending number ($S_{BN}$) | | - | | 61 | | | 53.25 | 59.2 | 45.5 | 63.2 |
| Incompatibility number ($I_N$) | | - | | 38 | | | 38 | 38 | 38 | 38 |
| $S_{BN}$ - $I_N$ | | - | | 23 | | | 15.3 | 21.2 | 7.5 | 25.2 |
| Compatibility - Rofa Test | ASTM D7157 | | | | | | | | | |
| S-value | | - | 1.74 | | | | | | | |
| $S_a$ | | - | 0.67 | | | | | | | |
| $S_0$ | | - | 0.57 | | | | | | | |
| $R^2$ | | - | 1.00 | | | | | | | |
| Solubility blending number ($S_{BN}$) | | - | 57 | | 73 | 69 | | | | |
| Incompatibility number ($I_N$) | | - | 33 | | 33 | 33 | | | | |
| $S_{BN}$ - $I_N$ | | - | 24 | | 40 | 36 | | | | |
| Total Sediment Potential (TSP) | ISO 10307-2 thermal aging | wt% | | | | | | | | |
| Spot Test – Cleanliness Rating | D4740 | - | | | | | | | | |

*Estimated values

FIG. 5

| | | Water (wppm) at Sampling Location | | | | |
|---|---|---|---|---|---|---|
| Fuel | Fuel to Water Ratio | Neat Fuel | Upper | Middle | Lower | Dead Bottom |
| 100% VLSFO | No water | 719 | | | | - |
| | 1000 to 1 | - | 744 | 794 | 623 | 1774 |
| | 500 to 1 | | 2228 | 2197 | 2002 | 3650 |
| | 100 to 1 | | 10753 | 10741 | 9628 | 16663 |
| | 10 to 1 | | 83439 | 201056 | ND* | ND* |
| 20% FAME / 80% VLSFO | No water | 567 | | | | - |
| | 1000 to 1 | - | 681 | 724 | 702 | 975 |
| | 500 to 1 | | 1658 | 1710 | 1572 | 2776 |
| | 100 to 1 | | 6448 | 6362 | 6535 | 20054 |
| | 10 to 1 | | 23211 | 30830 | 37978 | 59405 |
| 50% FAME / 50% VLSFO | No water | 792 | | | | - |
| | 1000 to 1 | - | 625 | 608 | 587 | 941 |
| | 500 to 1 | | 1572 | 1592 | 1498 | 2225 |
| | 100 to 1 | | 4630 | 6403 | 8359 | 19169 |
| | 10 to 1 | | 8629 | 15154 | 23035 | 22525 |

*Unobtainable

FIG. 6

| | | 100% VLSFO (cfu/L) | | | | 80% VLSFO / 20% FAME (cfu/L) | | | | 50% VLSFO / 50% FAME (cfu/L) | | | |
|---|---|---|---|---|---|---|---|---|---|---|---|---|---|
| Fuel to Water ratio | Day | Upper | Middle | Lower | Dead Bottom | Upper | Middle | Lower | Dead Bottom | Upper | Middle | Lower | Dead Bottom |
| 1000 to 1 | 7 | * | * | * | * | * | * | * | * | * | * | * | 1.00E+05 |
| | 14 | * | * | * | * | * | * | * | * | * | * | * | * |
| | 21 | * | * | * | * | * | * | * | * | * | * | * | * |
| | 28 | * | * | * | * | * | * | * | * | * | * | * | * |
| 500 to 1 | 7 | * | * | * | * | * | * | * | * | * | * | * | 1.00E+05 |
| | 14 | * | * | * | * | * | * | * | * | * | * | * | 3.60E+06 |
| | 21 | * | * | * | * | * | * | * | * | * | * | * | * |
| | 28 | * | * | * | * | * | * | * | * | * | * | * | * |
| 100 to 1 | 7 | * | * | * | * | * | * | * | * | * | * | * | 3.00E+07 |
| | 14 | * | * | * | * | * | * | * | * | * | * | 2.22E+07 | 1.00E+08 |
| | 21 | * | * | * | * | * | * | * | * | * | * | 1.20E+06 | 4.19E+07 |
| | 28 | * | * | * | * | * | * | * | * | * | * | * | 3.08E+07 |
| 10 to 1 | 7 | * | * | * | 9.00E+05 | * | * | * | * | * | * | * | 1.00E+08 |
| | 14 | * | * | * | 4.60E+06 | * | * | * | 1.00E+09 | * | * | 1.00E+09 | 1.00E+09 |
| | 21 | * | * | * | 7.00E+05 | * | * | * | 1.76E+07 | * | * | 8.00E+05 | 5.00E+08 |
| | 28 | * | * | * | * | * | * | * | * | * | * | * | 1.84E+07 |

*Below Detection Limit of 1.00E+05 cfu/L

FIG. 7

| | | 100% VLSFO (cfu/mL) | | | | 80% VLSFO / 20% FAME (cfu/mL) | | | | 50% VLSFO / 50% FAME (cfu/mL) | | | |
|---|---|---|---|---|---|---|---|---|---|---|---|---|---|
| Fuel to Water ratio | Day | Bacteria | Yeast | Mold | SRB | Bacteria | Yeast | Mold | SRB | Bacteria | Yeast | Mold | SRB |
| 1000 to 1 | 7 | | | | | | | | | 1.22E+06 | * | * | ND |
| | 14 | | | | | | | | | 2.70E+05 | * | * | ND |
| | 21 | | | | | | | | | 3.30E+05 | * | * | ND |
| | 28 | | | | | | | | | 2.50E+05 | 20 | * | ND |
| 100 to 1 | 7 | | | | | * | * | * | ND | | | | |
| | 14 | | | | | * | * | * | ND | | | | |
| | 21 | | | | | * | * | * | ND | | | | |
| | 28 | | | | | * | * | * | ND | | | | |
| 10 to 1 | 7 | 8.60E+03 | * | * | ND | 9.40E+06 | * | 20 | ND | | | | |
| | 14 | 2.10E+04 | * | * | ND | 1.40E+05 | * | * | ND | | | | |
| | 21 | 5.50E+03 | * | * | ND | 9.80E+04 | * | * | ND | | | | |
| | 28 | 2.90E+04 | * | * | ND | 2.60E+04 | * | * | ND | | | | |

*Below Detection Limit of 20 cfu/mL

ND = Not Detected

FIG. 8

| | | 100% VLSFO (cfu/mL) | | | | 80% VLSFO / 20% FAME (cfu/mL) | | | | 50% VLSFO / 50% FAME (cfu/mL) | | | |
|---|---|---|---|---|---|---|---|---|---|---|---|---|---|
| Fuel to Water ratio | Day | Bacteria | Yeast | Mold | SRB | Bacteria | Yeast | Mold | SRB | Bacteria | Yeast | Mold | SRB |
| 1000 to 1 | 7 | 100 | * | * | ND | 200 | * | * | * | 2000 | * | * | ND |
| | 14 | * | * | * | ND | * | * | * | * | * | * | * | ND |
| | 21 | * | * | * | ND | * | * | * | * | 200 | * | * | ND |
| | 28 | * | * | * | ND | * | * | * | * | * | * | * | ND |
| 500 to 1 | 7 | 100 | * | * | ND | 100 | * | * | ND | * | * | * | ND |
| | 14 | * | * | * | ND | 1200 | * | * | ND | * | * | * | ND |
| | 21 | 100 | * | * | ND | * | * | * | ND | * | * | * | ND |
| | 28 | * | * | * | ND | * | * | * | ND | * | * | * | ND |
| 100 to 1 | 7 | * | * | * | ND | * | * | * | ND | * | * | * | ND |
| | 14 | * | * | * | ND | * | * | * | ND | * | * | * | ND |
| | 21 | * | * | * | ND | * | * | * | ND | * | * | * | ND |
| | 28 | * | * | * | ND | * | * | * | ND | * | * | * | ND |
| 10 to 1 | 7 | * | * | * | ND | * | * | * | ND | * | * | * | ND |
| | 14 | * | * | * | ND | 200 | * | * | ND | * | * | * | ND |
| | 21 | * | * | * | ND | * | * | * | ND | * | * | * | ND |
| | 28 | * | * | * | ND | 200 | * | * | ND | * | * | * | ND |

*Below Detection Limit of 100 cfu/mL

ND = Not Detected

FIG. 9

| | Blend Component 1, vol% | Blend Component 2, vol% | Blend Component 3, vol% | Blend Component 4, vol% | Blend Component 5, vol% | Fuel 1, vol% | Fuel 2 vol% | Fuel 3, vol% | Fuel 4, vol% | Fuel 5, vol% | Fuel 6, vol% |
|---|---|---|---|---|---|---|---|---|---|---|---|
| Resid-containing fraction, vol% | 100 | | | | | 100 | 80 | 30 | 50 | 40 | 30 |
| Distillate fraction, vol% | | 100 | | | | | | 30 | | | |
| Waste-based fatty acid methyl ester, default, vol% | | | 100 | | | | 20 | | | | |
| Waste-based fatty acid methyl ester, typical, vol% | | | | 100 | | | | 40 | 50 | 40 | 70 |
| Renewable diesel, vol% | | | | | 100 | | | | | 20 | |
| Conventional Fraction, vol% | 100 | 100 | | | | 100 | 80 | 60 | 50 | 40 | 30 |
| Renewable Fraction, vol% | | | 100 | 100 | 100 | | 20 | 40 | 50 | 60 | 70 |
| Reduction in life cycle GHG emissions versus fossil comparator, % | | | 83 | 88 | 51 | | | | | | |
| Life cycle GHG emissions Factor (volume basis), $kgCO_2eq/l$ | 3.31 | 3.24 | 0.47 | 0.332 | 1.396 | 3.31 | 2.742 | 2.0978 | 1.821 | 1.736 | 1.2254 |
| Life cycle GHG emissions from consumption of $1000m^3$ Fuel, $kgCO_2eq$ | | | | | | 3310000 | 2742000 | 2097800 | 1821000 | 1736000 | 1225400 |
| Reduction in life cycle GHG emissions versus Fuel 1, from consumption of $1000m^3$ Fuel, % | | | | | | | 17% | 37% | 45% | 48% | 63% |

FIG. 10

| | FO6 | FAME6 | FO7 | Fuel 7<br>51% FO6 +<br>49% FAME6 |
|---|---|---|---|---|
| FO7, vol% | | | 100 | |
| FO6,vol% | 100 | | | 51 |
| FAME6, vol% | | 100 | | 49 |
| Conventional Fraction, vol% | 100 | | 100 | 51 |
| Renewable Fraction, vol% | | 100 | | 49 |
| Reduction in life cycle GHG emissions versus fossil comparator, % | | 89.4 | | |
| Life cycle GHG emissions Factor (volume basis), $kgCO_2eq/l$ | 3.31 | 0.293 | 3.31 | 1.832 |
| Life cycle GHG emissions from consumption of $1000m^3$ Fuel, $kgCO_2eq$ | | | 3310000 | 1831670 |
| Reduction in life cycle GHG emissions versus FO7, from consumption of $1000m^3$ Fuel, % | | | | 45 |

FIG. 11

| Test | Method | Unit | FO2 | FO2 + 50% Dist4 | 30% FO2 + 30% D4 + 40% FAME5 | FO 2 + 33% RD1 | 40% FO2 + 20% RD1 + 40% FAME5 |
|---|---|---|---|---|---|---|---|
| Density @ 15°C | D4052 | $g/cm^3$ | 0.972 | | | 0.9088 | 0.8950 |
| Kinematic Viscosity (KV) @ 50°C | D445 | $mm^2/s$ | 1238 | | | 52.12 | 12.34 |
| CCAI | Calc. | - | 822 | | | 794 | 807 |
| Sulfur | ISO 8754 | wt% | 0.58 | 0.31* | 0.19* | 0.42* | 0.25* |
| Carbon Residue, Micro | D4530 | wt% | 11.2 | | | 7.86 | 5.0 |
| Heptane Insolubles | D3279 | wt% | 4.3 | | | 4.4 | 1.0 |
| BMCI | Calc. | - | 63.8 | | | 37.5 | 44.6 |
| Toluene Equivalence (TE) | AM-S 79-004 | - | 41 | | | TBD | TBD |
| BMCI - TE | - | - | 22.8 | | | TBD | TBD |
| Compatibility - Rofa Test | ASTM D7157 | | | | | | |
| S-value | | - | 1.74 | | | 1.61 | 1.74 |
| $S_a$ | | - | 0.67 | | | 0.66 | 0.67 |
| $S_0$ | | - | 0.57 | | | 0.55 | 0.58 |
| $R^2$ | | - | 1.00 | | | 1.00 | 0.99 |
| Solubility blending number ($S_{BN}$) | | - | 57 | | | 53 | 55 |
| Incompatibility number ($I_N$) | | - | 33 | | | 34 | 33 |
| $S_{BN}$ - $I_N$ | | - | 24 | | | 19 | 22 |
| Total Sediment Potential (TSP) | ISO 10307-2 thermal aging | wt% | | <0.01 | <0.01 | 0.16 | <0.01 |
| Spot Test – Cleanliness Rating | D4740 | - | | | | 1 | 1 |

*Estimated values

FIG. 12

| Test | Method | Unit | FO2 | FO2 + 60% Dist3* | 20% FO2 + 30% D3 + 50% FAME5* | FO2 + 67% Dist4* | 20% FO2 + 40% D4 + 40% FAME5* |
|---|---|---|---|---|---|---|---|
| Density @ 15°C | D4052 | $g/cm^3$ | 0.972 | 0.8905 | 0.8836 | 0.8820 | 0.8799 |
| Kinematic Viscosity (KV) @ 50°C | D445 | $mm^2/s$ | 1238 | 12.7 | 6.3 | 9.5 | 6.2 |
| CCAI | Calc. | - | 822 | 802 | 812 | 800 | 809 |
| Sulfur | ISO 8754 | wt% | 0.58 | 0.25 | 0.13 | 0.21 | 0.13 |
| Carbon Residue, Micro | D4530 | wt% | 11.2 | 4.9 | 2.5 | 4.1 | 2.4 |
| Heptane Insolubles | D3279 | wt% | 4.3 | 1.9 | 0.9 | 1.6 | 0.9 |
| BMCI | Calc. | - | 63.8 | 41.4 | 40.7 | 40.8 | 40.5 |
| Toluene Equivalence (TE) | AM-S 79-004 | - | 41 | 41 | 41 | 41 | 41 |
| BMCI - TE | - | - | 22.8 | 0.4 | -0.3 | -0.2 | -0.5 |
| Compatibility - Rofa Test | ASTM D7157 | | | | | | |
| S-value | | - | 1.74 | | | | |
| $S_a$ | | - | 0.67 | | | | |
| $S_0$ | | - | 0.57 | | | | |
| $R^2$ | | - | 1.00 | | | | |
| Solubility blending number ($S_{BN}$) | | - | 57 | 38 | 77 | 38 | 69 |
| Incompatibility number ($I_N$) | | - | 33 | 33 | 33 | 33 | 33 |
| $S_{BN}$ - $I_N$ | | - | 24 | 5 | 44 | 5 | 36 |
| Total Sediment Potential (TSP) | ISO 10307-2 thermal aging | wt% | | | | | |
| Spot Test – Cleanliness Rating | D4740 | - | | | | | |

*Estimated values

FIG. 13

MARINE FUEL COMPOSITIONS

CROSS-REFERENCE TO RELATED APPLICATIONS

This application claims the benefit of U.S. Provisional Application No. 63/119,326, filed on Nov. 20, 2020, and Patent Cooperation Treaty Application No. PCT/US2021/033988, filed on May 25, 2021, which claims the benefit of U.S. Provisional 63/036,495, filed on Jun. 9, 2020, the entire contents of all which are incorporated herein by reference.

FIELD

This disclosure relates to residual marine fuels containing a blend of at least one residual fraction and at least one renewable fraction.

BACKGROUND

Due to recent changes by the International Maritime Organization (IMO) in January 2020, marine fuels are now required to have no more than 0.5 wt % sulfur in order to reduce sulfur oxide emissions. This is a substantial reduction from the prior sulfur limit of 3.5 wt %. In some coastal areas, known as Emission Control Areas (ECA), the sulfur limit is 0.1% (m/m). Going forward, still further low carbon fuel solutions are likely to be needed to meet the IMO 2050 target to reduce marine carbon emissions by 50% from their 2008 levels.

Typical marine fuels have sulfur content above the new regulatory limits because sulfur contaminants are concentrated in the heavy fractions of crude oil ("residue") used for marine fuel blending. Typical solutions for reducing sulfur in marine fuels include desulfurization and dilution of high sulfur residue with a low-sulfur blend component, referred to as a "flux," which is often a distillate. Desulfurization is expensive and carbon-intensive because it requires substantial energy and hydrogen. Dilution is commonly used, but it can destabilize residual marine fuel and promote sediment and sludge formation. Residue contains asphaltenes that are typically kept in solution by a high concentration of aromatic molecules in the fuel. However, the distillate fuels used as flux are generally much less aromatic than residue, and dilution of a residue with a typical distillate flux can cause the asphaltenes to precipitate.

A Concawe report titled "Study to evaluate test methods to assess the stability and compatibility of marine fuels in view of the IMO MARPOL Annex VI Regulation 14.1.3 for 2020 Sulphur requirements" was issued in November, 2019.

What is needed are improved fuel oil compositions, and methods for forming such fuel oil compositions, that can allow low sulfur fuel targets to be achieved while reducing or minimizing sediment formation, sludge formation, and/or other issues related to incompatibility of fuel oil compositions. Also there is a need for fuel oil compositions that have a potential to yield a reduced life cycle carbon intensity and also assist with reducing overall marine carbon emissions.

SUMMARY

In various aspects, a fuel or fuel blending composition is provided. The fuel or fuel blending composition can include 20 vol % or more of a conventional resid-containing fraction and 5 vol % to 80 vol % of one or more renewable fractions, such as one or more fatty acid alkyl esters. Optionally, the one or more fatty acid alkyl esters can have a BMCI of 50 or less and a $S_{BN}$ of 55 or more. Methods for forming such a fuel or fuel blending composition are also provided. Optionally, the fuel or fuel blending composition can further include a secondary flux. The secondary flux can correspond to additional renewable flux such as a renewable distillate, or conventional distillate flux. Optionally, the amount of secondary flux can correspond to 30 vol % or more of the fuel or fuel blending composition. Optionally, the amount of renewable flux, including both fatty acid alkyl ester and secondary flux, can correspond to 60 vol % or more of the fuel or fuel blending composition. Optionally, the resulting fuel or fuel blending composition can have a BMCI–TE difference value of 15 or less.

In one form of the instant disclosure, provided is a marine fuel or fuel blending composition comprising: at least 20 vol % of a resid-containing fraction, and from 5 vol % to 80 vol % of one or more renewable fuel blending components, wherein the one or more renewable fuel blending components includes one or more fatty acid alkyl esters.

In another form of the instant disclosure, provided is a method of making a marine fuel or fuel blending composition, comprising: providing a resid-containing fraction and one or more renewable fuel blending components, blending at least 20 vol % of the resid-containing fraction with from 5 vol % to 80 vol % of the one or more renewable fuel blending components to form a marine fuel or fuel blending composition, wherein the one or more renewable fuel blending components includes one or more fatty acid alkyl esters.

In yet another form of the instant disclosure, provided is a method of reducing the life cycle carbon intensity of a marine fuel or a fuel blending composition, comprising: providing a resid-containing fraction and one or more renewable fuel blending components, blending at least 20 vol % of the resid-containing fraction with from 5 vol % to 80 vol % of the one or more renewable fuel blending components to form a marine fuel or fuel blending composition, calculating the carbon intensity reduction on a life cycle basis of the marine fuel or fuel blending composition compared to a comparable marine fuel or fuel blending composition not including the one or more renewable fuel blending components according to the methodology in Directive 2009/30/EC of the European Parliament and of the Council, wherein the one or more renewable fuel blending components includes one or more fatty acid alkyl esters, and wherein the carbon intensity reduction on a life cycle basis of the marine fuel or fuel blending composition is at least 10% lower than a comparable marine fuel or fuel blending composition not including the one or more renewable fuel blending components.

BRIEF DESCRIPTION OF THE DRAWINGS

To assist those of ordinary skill in the relevant art in making and using the subject matter hereof, reference is made to the appended drawings, wherein:

FIG. 1 shows properties for various fuel oil fractions, conventional distillate fractions, and renewable distillate fractions.

FIG. 2 shows compositional information and properties for various fatty acid methyl ester fractions and resid-containing fractions.

FIG. 3 shows properties for blends formed from the fractions shown in FIG. 2.

FIG. 4 shows properties for blends formed from the fractions shown in FIG. 2.

FIG. 5 shows modeled properties for blends formed using a combination of fatty acid alkyl ester and conventional distillate flux.

FIG. 6 shows water affinity properties for conventional residual fuel and blends formed using a combination of fatty acid methyl ester and conventional residual fuel.

FIG. 7 shows fuel phase microbiological growth data for conventional residual fuel and for blends formed using a combination of fatty acid methyl ester and conventional residual fuel.

FIG. 8 shows water layer microbiological growth data for conventional residual fuel and for blends formed using a combination of fatty acid methyl ester and conventional residual fuel.

FIG. 9 shows microbiological growth data for suspended water droplets in conventional residual fuel and in blends formed using a combination of fatty acid methyl ester and conventional residual fuel.

FIG. 10 illustrates reducing life cycle GHG emissions ("carbon intensity") by including renewable blending components in a marine fuel blend, such as fatty acid methyl ester, or fatty acid methyl ester in combination with hydrotreated vegetable oil.

FIG. 11 illustrates calculation of life cycle carbon intensity reduction for a marine fuel blend containing 49 vol % fatty acid methyl ester and 51 vol % of a resid-containing blend component, compared to a comparable marine fuel not containing one or more renewable blending components.

FIG. 12 shows partial measured property data for hand blends that correspond to the modeled blends in Table 3 and FIG. 5.

FIG. 13 shows modeled properties for additional blends formed using a combination of fatty acid alkyl ester and conventional or renewable distillate flux.

DETAILED DESCRIPTION

All numerical values within the detailed description and the claims herein are modified by "about" or "approximately" the indicated value, and take into account experimental error and variations that would be expected by a person having ordinary skill in the art.

"Major amount" as it relates to components included within the fuel compositions of the specification and the claims means greater than or equal to 50 wt. %, or greater than or equal to 60 wt. %, or greater than or equal to 70 wt. %, or greater than or equal to 80 wt. %, or greater than or equal to 90 wt. % based on the total weight of the fuel.

"Minor amount" as it relates to components included within the fuel compositions of the specification and the claims means less than 50 wt. %, or less than or equal to 40 wt. %, or less than or equal to 30 wt. %, or greater than or equal to 20 wt. %, or less than or equal to 10 wt. %, or less than or equal to 5 wt. %, or less than or equal to 2 wt. %, or less than or equal to 1 wt. %, based on the total weight of the fuel.

"Essentially free" as it relates to components included within the fuel compositions of the specification and the claims means that the particular component is at 0 weight % within the fuel composition, or alternatively is at impurity type levels within the fuel (less than 100 wppm, or less than 20 wppm, or less than 10 wppm, or less than 1 wppm).

Fuel "fraction" or alternatively fuel "blending component", which may be used interchangeably in the specification and the claims, refers to a liquid constituent that is blended with other fuel fractions or fuel blending components into the overall fuel composition.

In various aspects, it has been discovered that fatty acid alkyl esters can provide unexpected benefits when used as a blend component for forming residual marine fuels and/or fuel blending components. Although fatty acid alkyl esters have relatively low Bureau of Mines Correlation Index (BMCI) values, it has been discovered that fatty acid alkyl esters have unexpectedly high compatibility with residual fractions. As a result, addition of fatty acid alkyl ester to a vacuum resid or an atmospheric resid fraction can result in reduced or minimized sediment and/or sludge formation relative to addition of a conventional distillate flux fraction. This can be beneficial for forming marine residual fuel oils, where distillate flux is typically used to improve the properties of a resid fraction by a sufficient amount to satisfy one or more values in a marine fuel oil specification. The unexpected reduction in sediment and/or sludge formation can allow fatty acid alkyl esters to be used as a flux for challenged resid fractions that otherwise would be prone to sediment formation when blended with a conventional distillate flux.

Conventionally, many types of marine residual fuels (and/or fuel blending components) are made by blending an optionally hydrotreated vacuum resid fraction with a hydrotreated distillate flux. Part of the benefit of blending the vacuum resid fraction with the hydrotreated distillate flux is that the sulfur level of the resulting blend is reduced relative to the sulfur content of the optionally hydrotreated vacuum resid fraction. Other benefits can include reducing the kinematic viscosity and/or density of the blend relative to the vacuum resid fraction, so that the resulting blend can satisfy the specifications for one or more types of residual fuel oil.

Although distillate flux is effective for reducing sulfur, kinematic viscosity, and density of a vacuum resid fraction, blending a distillate flux with vacuum resid can also pose challenges with regard to maintaining solubility of various types of aromatic species within a resid fraction. If too much distillate flux is added to a resid fraction, asphaltenes and/or other multi-ring aromatic species within the resid fraction can potentially phase separate, resulting in sediment and/or sludge formation.

The Bureau of Mines Correlation Index (BMCI) is commonly used to characterize fractions corresponding to and/or including an atmospheric resid fraction or a vacuum fraction. This is in part due to the relative ease with which BMCI values can be determined. Based in part on the availability of BMCI values, a common way of evaluating the compatibility of fractions for blending is based on the difference between BMCI values and the toluene equivalence (TE) values of the fractions. Generally, a sample that has a BMCI value that is greater than the TE value by 15 or more indicates that the sample has sufficient solvation power to maintain asphaltenes and/or other multi-core aromatic compounds in solution. By contrast, a difference between BMCI and TE (also referred to as a BMCI–TE value) of 15 or less indicates that sediment is likely to form (and/or a cleanliness rating of 3 or more will occur during a spot test according to ASTM D4740) due to precipitation of asphaltenes and/or other multi-core aromatics. However, in some instances, a BMCI–TE value of 12 or more can still correspond to sample with sufficient solvation power to maintain compatibility. This would correspond to a BMCI–TE value of 12 or less being an indicator of likely precipitation of asphaltenes. Generally, a BMCI–TE value of 10 or less for a sample can indicate that sediment formation will occur and/or a spot rating of 3 or more will occur during a spot test according to ASTM D4740.

When two fractions are blended, the BMCI value of the resulting blend is typically similar to the weighted average of the BMCI values of the blend components. However, when at least 10 vol % of a resid fraction is included in a blend, the TE value of the blend is typically similar to the TE value of the resid fraction. The TE value is an indicator of the types of multi-core aromatic compounds present within a fraction. For the multi-core aromatics that lead to sediment or sludge formation, however, simply reducing the concentration to avoid sediment formation does not become effective until the concentration has been reduced to a de minimis level. Thus, the presence of even a few percent of a resid fraction in a blend can lead to incompatibility issues if the aromatic solvation power of the blend is too low.

It has been discovered that fatty acid alkyl esters have an unexpectedly high compatibility for blending with resid fractions. Fatty acid alkyl esters can typically have BMCI values of around 40 or less. This is similar to the BMCI values of around 30 that are typical of various types of hydrotreated distillate fractions that are commonly used as distillate flux for blending with resid fractions to form marine fuel oils (and/or fuel blending components). However, it has been unexpectedly discovered that fatty acid alkyl esters have substantially greater compatibility for blending with resid fractions while reducing or minimizing formation of sediment and/or sludge. The unexpected compatibility of fatty acid alkyl esters for blending with resid fractions can be further seen in the unexpected difference between BMCI values and solubility blending numbers for fatty acid alkyl ester fractions. It has been discovered that fatty acid alkyl ester fractions have unexpectedly high solubility blending numbers ($S_{BN}$) relative to the corresponding BMCI values. As a result, when forming a blend of a resid-containing fraction with a fatty acid alkyl ester fraction, the resulting blend can have an unusually high $S_{BN}$. In some aspects, using a fatty acid alkyl ester fraction as a flux for a resid-containing fraction can provide the unexpected combination of reducing the density, kinematic viscosity, and optionally sulfur content of a blend while also maintaining or increasing the compatibility. This is in contrast to the expected behavior of a blend where flux is added. Conventionally, addition of flux to a resid-containing fraction can reduce one or more of density, kinematic viscosity, and sulfur, but with a corresponding reduction in compatibility.

In some aspects, a blend of one or more fatty acid alkyl esters and a resid-containing fraction can include 5.0 vol % or more of the one or more fatty acid alkyl esters, or 10 vol % or more, or 15 vol % or more, or 20 vol % or more, or 25 vol % or more, or 30 vol % or more, or 35 vol % or more, or 40 vol % or more, or 45 vol % or more, or 50 vol % or more. For example, the blend can include 5.0 vol % to 80 vol % of the one or more fatty acid alkyl esters, or 10 vol % to 80 vol %, or 20 vol % to 80 vol %, or 30 vol % to 80 vol %, or 40 vol % to 80 vol %, or 50 vol % to 80 vol %, or 5.0 vol % to 60 vol %, or 10 vol % to 60 vol %, or 20 vol % to 60 vol %, or 10 vol % to 50 vol %, or 20 vol % to 50 vol %, or 30 vol % to 50 vol %, or 40 vol % to 50 vol %. The blend can further include 20 vol % or more of a resid-containing fraction, or 40 vol % or more, or 50 vol % or more, such as up to 90 vol % of a resid-containing fraction. Fatty acid methyl ester, fatty acid ethyl ester, fatty acid propyl ester, fatty acid butyl ester, or combinations thereof are non-limiting exemplary fatty acid alkyl esters. Optionally, the blend can further include 75 vol % or less of a secondary distillate flux, or 60 vol % or less, or 55 vol % or less, or 50 vol % or less, or 45 vol % or less, or 40 vol % or less, or 35 vol % or less, or 30 vol % or less, or 20 vol % or less, or 10 vol % or less, or 5 vol % or less, or 2 vol % or less, such as down to including substantially no secondary distillate flux (0.1 vol % or less). For example, the blend can include 2 vol % to 75 vol % of secondary flux, or 5 vol % to 60 vol %, or 5 vol % to 40 vol %, or 5 vol % to 30 vol %, or 5 vol % to 20 vol %, or 10 vol % to 50 vol %, or 20 vol % to 40 vol %. Examples of a secondary flux can include conventional distillate/diesel fractions, renewable distillate/diesel fractions (such as, but not limited to, hydrotreated vegetable oil), and/or other types of distillate boiling range fractions. Optionally, the blend can further include 50 vol % or less of a secondary distillate flux, or 45 vol % or less, or 40 vol % or less, or 35 vol % or less, or 30 vol % or less, or 20 vol % or less, or 10 vol % or less, or 5 vol % or less, or 2 vol % or less, such as down to including substantially no secondary distillate flux (0.1 vol % or less). For example, the blend can include 2 vol % to 45 vol % of secondary flux, or 5 vol % to 35 vol %, or 10 vol % to 30 vol %. Examples of a secondary flux can include conventional distillate/diesel fractions, renewable distillate/diesel fractions (such as, but not limited to, hydrotreated vegetable oil), and/or other types of distillate boiling range fractions.

In various aspects, the resid-containing fraction can be characterized based on the compatibility properties of the resid-containing fraction. For example, the resid-containing fraction can have one or more of a BMCI of 30 or more, or 40 or more, or 50 or more, or 60 or more, or 70 or more, such as up to 120; a TE of 5 or more, or 20 or more, or 30 or more, or 40 or more, such as up to 80; a solubility blending number ($S_{BN}$) of 60 or more, or 70 or more, such as up to 120; and/or an insolubility number ($I_N$) of 30 or more, or 35 or more, such as up to 80. In some aspects, the resid-containing fraction can also be characterized based on difference values. Two types of difference values are defined in this discussion. One difference value is a difference between BMCI and TE for a fraction (a BMCI−TE value). This difference value can be calculated by subtracting the TE value from the BMCI value. For a resid-containing fraction, the BMCI−TE value can be 50 or less, or 40 or less, or 30 or less, or 20 or less, such as down to 0. The second difference value is a difference between $S_{BN}$ and $I_N$ for a fraction (a $S_{BN}$−$I_N$ difference value). This difference value can be calculated by subtracting the $I_N$ value from the $S_{BN}$ value for a fraction. For a resid-containing fraction, the $S_{BN}$−$I_N$ difference value can be 40 or less, or 30 or less, such as down to 5 or possibly still lower.

In some aspects, it may be desirable to form a blend corresponding to a resid-containing fraction and an elevated level of flux (also referred to as total flux), such as a blend including 25 vol % or more of flux, or 30 vol % or more, or 40 vol % or more, such as up to 80 vol % or possibly still higher. In such aspects, one option can be to have substantially all of the elevated level of flux correspond to fatty acid alkyl esters. Another option can be to have the elevated level of flux (or total flux) correspond to a combination of fatty acid alkyl esters and secondary flux. Using an elevated level of flux, where at least portion of the flux corresponds to fatty acid alkyl esters (and optionally other types of renewable distillate fractions), can be beneficial for forming marine fuels that meet or exceed current and future regulatory standards regarding incorporation of renewable material into fuel products. Depending on the aspect, the amount of flux or total flux in the fuel composition can correspond to 5 vol % to 80 vol %, or 25 vol % to 50 vol %, or 30 vol % to 80 vol %, or 30 vol % to 50 vol %, or 40 vol % to 80 vol %. In some aspects, substantially all of the flux in the blend can correspond to fatty acid alkyl esters. In other aspects, where at least one secondary flux is used, the amount of fatty acid alkyl ester in the fuel composition can correspond to 5 vol % to 78 vol %, or 5 vol % to 30 vol %, or 5 vol % to 20 vol %, or 10 vol % to 50 vol %, or 10 vol % to 30 vol %, or 15 vol % to 78 vol %, or 15 vol % to 50 vol %, or 20 vol % to 78 vol %, or 20 vol % to 50 vol %. In such aspects, the amount of renewable flux (also referred to as renewable total flux) in the fuel composition (i.e., fatty acid alkyl ester plus other renewable distillate (also referred to as renewable secondary flux), such as hydrotreated vegetable oil) can correspond to 7 vol % to 80 vol %, or 7 vol % to 30 vol %, or 7 vol % to 20 vol %, or 10 vol % to 50 vol %, or 10 vol % to 30 vol %, or 15 vol % to 80 vol %, or 15 vol % to 50 vol %, or 20 vol % to 50 vol %, or 25 vol % to 80 vol %, or 25 vol % to 50 vol %, or 30 vol % to 80 vol %, or 30 vol % to 50 vol %.

In some aspects, other properties of a resid-containing fraction can include one or more of a T90 distillation point of 550° C. or more; a kinematic viscosity at 50° C. of 30 cSt or more, or 100 cSt or more, or 200 cSt or more, such as up to 1000 cSt; a density at 15° C. of 0.95 g/cm$^3$ or more, such as up to 1.06 g/cm$^3$; and/or a micro carbon residue content of 5.0 wt % to 15 wt %. In some aspects, the resid-containing fraction can have a sulfur content of 1000 wppm to 10,000 wppm. In some aspects, the resid-containing fraction can have a sulfur content of 0.5 wt % (5000 wppm) or more, or 1.0 wt %, such as up to 5.0 wt %.

The one or more fatty acid alkyl esters can have various properties. In some aspects, the one or more fatty acid alkyl esters can have a BMCI value of 50 or less, a $S_{BN}$ value of 55 or more, or a combination thereof. Optionally, the $S_{BN}$ value of the one or more fatty acid alkyl esters can be higher than the $S_{BN}$ value of the resid-containing fraction. In some aspects, a fatty acid alkyl ester can include an alkyl group containing between 1 carbon (fatty acid methyl ester) to 10 carbons (fatty acid decyl ester), or 1 to 8 carbons, or 1 to 6 carbons, or 1 to 4 carbons. In some aspects, a fatty acid alkyl ester fraction can include a blend of two or more types of fatty acid alkyl esters. The fatty acid alkyl esters in a blend of fatty acid alkyl esters can correspond to a blend of esters with different fatty acids, a blend of esters with different alkyl groups, or a blend of esters including both different fatty acid and different alkyl groups. In some aspects, a fatty acid alkyl ester fraction can correspond to a fatty acid methyl ester fraction that meets the requirements provided in EN 14214. In some aspects, a fatty acid alkyl ester fraction can correspond to a fraction that meets the requirements described in ASTM D6751. In some aspects, a fatty acid alkyl ester fraction can be a fraction formed at least in part by transesterification of a feedstock corresponding to canola oil; palm oil; palm oil mill effluent; rapeseed oil; corn oil; soybean oil; tallow; cooking oil (such as vegetable cooking oil); used cooking oil (such as used vegetable cooking oil); or a combination thereof.

The fuel composition (and/or fuel blending composition) formed by blending a resid-containing fraction with one or more fatty acid alkyl esters can also be characterized based on the compatibility properties of the resid-containing fraction. For example, the fuel composition can have a BMCI value of 59 or less, or 55 or less, or 50 or less, such as down to 30 or possibly still lower. Additionally or alternately, the fuel composition can have a BMCI–TE difference value of 30 or less, or 20 or less, or 15 or less, or 12 or less, or 10 or less, such as down to −20 or possibly still lower. Further additionally or alternately, a fuel composition can have a $S_{BN}$–$I_N$ difference value of 20 or more, or 25 or more, or 30 or more, such as up to 60 or possibly still higher. A $S_{BN}$–$I_N$ difference value of 20 or more generally indicates a compatible blend.

In some aspects, the fuel compositions disclosed herein can have one or more of a kinematic viscosity at 50° C. between 2 cSt and 380 cSt, or between 2 cSt and 180 cSt, or between 2 cSt and 80 cSt, or between 2 cSt and 60 cSt, or between 2 cSt and 30 cSt, or between 4.5 cSt and 380 cSt, or between 4.5 cSt and 180 cSt, or between 4.5 cSt and 80 cSt, or between 4.5 cSt and 60 cSt, or between 4.5 cSt and 30 cSt, or between 4.5 cSt and 10 cSt, or between 8 cSt and 380 cSt, or between 8 cSt and 180 cSt, or between 8 cSt and 80 cSt, or between 8 cSt and 60 cSt, or between 8 cSt and 30 cSt, or between 10 cSt and 380 cSt, or between 10 cSt and 180 cSt, or between 10 cSt and 80 cSt, or between 10 cSt and 60 cSt, or between 10 cSt and 30 cSt; a micro carbon residue of 0.5 wt % or more, or 1 wt % or more, or 2 wt % or more, or 5 wt % or more, or 10 wt % or more, or 15 wt % or more, such as up to 18 wt %; an asphaltene content of 0.5 wt % or more, or 1 wt % or more, or 1.5 wt % or more, or 2 wt % or more, or 3 wt % or more, or 5 wt % or more, or 10 wt % or more or possibly still higher; a density at 15° C. of between 0.87 and 1.05 g/cm$^3$, or between 0.89 and 1.05 g/cm$^3$, or between 0.90 and 1.05 g/cm$^3$, or between 0.92 and 1.05 g/cm$^3$, or between 0.96 and 1.05 g/cm$^3$, or between 0.975 and 1.05 g/cm3, or between 0.87 and 1.00 g/cm$^3$, or between 0.87 and 0.991 g/cm$^3$, or between 0.87 and 0.975 g/cm$^3$, or between 0.87 and 0.96 g/cm$^3$, or between 0.87 and 0.92 g/cm$^3$, or between 0.89 and 0.991 g/cm$^3$, or between 0.89 and 0.975 g/cm$^3$, or between 0.90 and 0.991 g/cm$^3$, or between 0.90 and 0.975 g/cm$^3$; and/or a sulfur content of 10,000 wppm or less, or 5000 wppm or less (such as 1500 wppm to 5000 wppm, or 4000 wppm to 5000 wppm), or 1000 wppm or less (such as 800 wppm to 1000 wppm), such as down to 10 wppm or possibly still lower. In some aspects, the fuel compositions disclosed herein can have a sulfur content of 500 wppm or more, or 800 wppm or more, or 1000 wppm or more, or 2000 wppm or more, or 4000 wppm or more, such as up to 1000 wppm or 5000 wppm.

The fuel compositions (and/or fuel blending compositions) disclosed herein can also have a low sediment content and/or a favorable value for the spot test cleanliness rating according to ASTM D4740. In some aspects, the fuel compositions disclosed herein can have a sediment content according to ISO 10307-2 Procedure A or B of 0.1 wt % or less, or 0.07 wt % or less, or 0.05 wt % or less, or 0.02 wt % or less, such as down to having substantially no sediment (less than 0.01 wt %). Additionally or alternately, the fuel compositions disclosed herein can have a spot test cleanliness rating (ASTM D4740) of 1 or 2.

When forming a residual marine fuel, in addition to a resid-containing fraction and a fatty acid alkyl ester fraction, any other convenient type of blend component can also be included (also referred to as a secondary flux). Thus, the resid-containing fraction and the fatty acid alkyl ester fraction may be blended with any of the following and any combination thereof (also referred to as a secondary flux) to make a fuel oil: low sulfur diesel (sulfur content of less than 500 wppm), ultra low sulfur diesel (sulfur content <10 or <15 wppm), low sulfur gas oil, ultra low sulfur gasoil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, non-hydrotreated straight-run diesel, non-hydrotreated straight-run kerosene, non-hydrotreated straight-run gas oil and any distillates derived from low sulfur crude slates, gas-to-liquid wax, and other gas-to-liquid hydrocarbons, non-hydrotreated cycle oil, non-hydrotreated fluid catalytic cracking slurry oil, non-hydrotreated pyrolysis gas oil, non-hydrotreated cracked light gas oil, non-hydrotreated cracked heavy gas oil, non-hydrotreated pyrolysis light gas oil, non-hydrotreated pyrolysis heavy gas oil, non-hydrotreated thermally cracked residue, non-hydrotreated thermally cracked heavy distillate, non-hydrotreated coker heavy distillates, non-hydrotreated vacuum gas oil, non-hydrotreated coker diesel, non-hydrotreated coker gasoil, non-hydrotreated coker vacuum gas oil, non-hydrotreated thermally cracked vacuum gas oil, non-hydrotreated thermally cracked diesel, non-hydrotreated thermally cracked gas oil, synthetic renewable hydrocarbons such as gas-to-liquid hydrocarbons from renewable synthesis gas (from gasification of biomass, municipal solid waste, or other renewable feedstocks), hydrotreated natural fats or oils (such as hydrotreated vegetable oils including soy oil, canola oil, rapeseed oil, etc., or hydrotreated animal oils and fats such as fish oils, chicken fat or beef tallow), hydrotreated waste cooking oils, hydrotreated tall oil, oxygenates such as ethers (diethyl ether, methyl t-butyl ether) or alcohols (methanol, ethanol) or esters or acids or carboxylic acids (fatty acids, resin acids) or cyclic oxygenates (sugars, C6 lignin derivatives) or combinations thereof; Group 1 slack waxes, lube oil aromatic extracts, deasphalted oil, atmospheric tower bottoms, vacuum tower bottoms, steam cracker tar, any residue materials derived from low sulfur crude slates, ultra low sulfur fuel oils (ULSFO) with sulfur level up to 0.1 wt %, very low sulfur fuel oil (VLSFO) with sulfur level up to 0.5 wt %, low sulfur fuel oils (LSFO) with sulfur level up to 1 wt %, regular sulfur fuel oil (RSFO; also called high sulfur fuel oil, HSFO) with sulfur level up to 3.5 wt %, other ULSFO/VLSFO/LSFO/RSFO blend stocks.

As needed, the fuel compositions or fuel blending component fractions disclosed herein may be additized with one or more fuel additives, such as pour point improver, combustion improver, flocculant, dispersant, $H_2S$ scavenger, antioxidant, stability improver, compatibility improver, etc., and combinations thereof at concentrations ranging from 5 vppm to up to 1 vol %, or 5 vppm to up to 0.8 vol %, or 5 vppm to up to 0.6 vol %, or 5 vppm to up to 0.4 vol %, or 5 vppm to up to 0.3 vol %, or 5 vppm to up to 2000 vppm, or 100 vppm to up to 1.0 vol %, or 500 vppm to up to 1.0 vol %, or 1000 vppm to up to 1.0 vol %, or 2000 vppm to up to 1.0 vol %, or 0.3 vol % to up to 1.0 vol %, 0.4 vol % to up to 1.0 vol %, 0.5 vol % to up to 1.0 vol %, or 50 vppm to 0.8 vol %, or 500 vppm to 0.6 vol %, or 1000 vppm to 0.4 vol %, to improve properties and/or meet local specifications.

In addition to having unexpected benefits for reducing or minimizing sediment or sludge formation in marine residual fuels, use of fatty acid alkyl esters are also beneficial for use in marine residual fuels based on the potential reduced carbon intensity of fatty acid alkyl esters as a blend component. By using renewable blending components such as fatty acid alkyl esters as at least a partial replacement for conventional fuel blending components when forming a marine residual fuel, the life cycle carbon intensity ($gCO_2e$/MJ or $kgCO_2eq$/liter) of a marine residual fuel can be reduced by potentially 2% or more, or 5% or more, or 10% or more, or 15% or more, or 20% or more, or 25% or more, or 30% or more, or 35% or more, or 40% or more, or 45% or more, or 50% or more, or 60% or more, such as up to having a 70% reduction or possibly still more. The potential reduction in life cycle carbon intensity for a marine residual fuel may vary depending on factors such as (1) the blend level of renewable blending components as a percentage of the marine residual fuel final blend, and (2) the carbon intensity reduction of the renewable blending components blended in the marine residual fuel. The potential reduction in life cycle carbon intensity may be calculated according to the guidelines and procedures in "Life Cycle Assessment and Carbon Intensity" sub section disclosed herein.

The use of fatty acid alkyl esters in marine residual fuels was also discovered to reduce nitrogen oxide (NOx) emissions from diesel engines on a marine vessel. The potential NOx reduction is surprising and unexpected due to published studies for on-road diesel fuel and heavy duty diesel engines which demonstrated that on average NOx increases at higher levels of fatty acid alkyl ester blending. For example, an analysis by the United States Environmental Protection Agency found that, on average, fatty acid alkyl ester blending increased NOx emissions for heavy-duty diesel highway engines, see US EPA Report "A Comprehensive Analysis of Biodiesel Impacts on Exhaust Emissions Draft Technical Report," EPA420P-02-001, October 2002, figure ES-A. The specific factors underlying potential NOx reduction for combustion of marine residual fuel blends with fatty acid alkyl ester versus on-road diesel fuel blends are unknown. Possible contributing factors include fundamentally different operating conditions of on-road and marine diesel engines, such as different engine speed (rpm) or combustion temperature, and significant differences in the composition of the petroleum component combined with the fatty acid alkyl esters for each engine/fuel type. By using fatty acid alkyl esters as at least a partial replacement for conventional marine fuel, the NOx emissions may be reduced by potentially 2% or more, or 5% or more, or 10% or more, or 15% or more, or 20% or more, or possibly still more. Potential NOx emissions reduction depends on multiple factors related to the fuel composition and marine vessel hardware and operation, such as (1) the blend level of renewable blending components as a percentage of the marine residual fuel final blend, (2) the chemical composition of the renewable blending components such as whether the renewable blending components contain hydrocarbon, oxygenate, or other chemical species, and (3) engine hardware design and engine load conditions, so variation in the magnitude of the potential NOx reduction may be possible.

The use of fatty acid alkyl esters are also beneficial for the marine residual fuels disclosed herein because they can potentially reduce particulate matter within the combustion process. By using fatty acid alkyl esters as at least a partial replacement for conventional marine fuel, the particulate emissions can potentially be reduced by potentially 2% or more, or 5% or more, 10% or more, 20% or more, 30% or more, 40% or more, or 50% or more, or possibly still more. In terms of visual observation, by using fatty acid alkyl esters as at least a partial replacement for conventional marine fuel, particulate emissions which are observable to the human eye may potentially be reduced by a sufficient amount such that the particulate matter emissions are difficult to detect by the human eye, or possibly still more, such that they are no longer visually detectable by the human eye. Potential PM emissions reduction depends on multiple factors related to the fuel composition and marine vessel hardware and operation, such as (1) the blend level of renewable blending components as a percentage of the marine residual fuel final blend, (2) the chemical composition of the renewable blending components such as whether the renewable blending components contain hydrocarbon, oxygenate, or other chemical species, and (3) engine hardware design and engine load conditions, so variation in the magnitude of the potential PM emissions reduction may be possible.

The lower carbon intensity, NOx emissions, and PM emissions of the residual marine fuels disclosed herein including a fatty acid alkyl ester fraction can be realized by using such a fuel in any convenient type of combustion powered device. In some aspects, a marine residual fuel containing a fatty acid alkyl ester fraction can be used as fuel for a combustion engine in a marine vessel or another convenient type of vehicle. Still other non-limiting exemplary types of combustion devices can include generators, furnaces, boilers, and other combustion devices that are used to provide heat or power.

Laboratory testing comparing the inventive marine fuel blends containing fatty acid methyl esters to conventional marine fuel unexpectedly showed similar water affinity performance and similar low levels of microbiological growth. Diesel fuel blends containing fatty acid alkyl esters have been shown to have higher water content and microbiological growth than conventional fuels. However, this effect is not seen when fatty acid alkyl esters are blended into the residual marine fuels disclosed herein.

In some aspects, it may be desirable to form a marine fuel composition containing a conventional fraction and a renewable fraction, thereby providing reduced life cycle carbon intensity compared to a conventional marine fuel, but with no residue content. For example, this option may be desirable for combustion devices on marine vessels which are incompatible with resid content. In such aspects, one option for an alternative form of the instant invention may be to have a blend of conventional distillate with a fatty acid methyl ester. Another option for an alternative form of the instant invention may be to have a blend of conventional distillate with a renewable distillate.

Compatibility Characterization of Residual Fractions and Residual Marine Fuels

The Bureau of Mines Correlation Index (BMCI) provides a method for characterizing the ability of a fuel oil fraction to maintain solubility of compounds such as asphaltenes. The BMCI index can be calculated based on Equation (1):

$$BMCI = \frac{48640}{VABP} + (473.7 \times d_{60}) - 456.8 \quad (1)$$

In Equation (1), VABP refers to the volume average boiling point (in degrees Kelvin) of the fraction, which can be determined based on the fractional weight boiling points for distillation of the fraction at roughly 10 vol % intervals from ~10 vol % to ~90 vol %. The "$d_{60}$" value refers to the density in g/cm$^3$ of the fraction at ~60° F. C16° C.). While this definition does not directly depend on the nature of the compounds in the fraction, the BMCI index value is conventionally believed to provide an indication of the ability of a fuel oil fraction to solvate asphaltenes.

An additional/alternative method of characterizing the solubility properties of a fuel oil (or other petroleum fraction) can correspond to the toluene equivalence (TE) of a fuel oil, based on the toluene equivalence test as described, for example, in U.S. Pat. No. 5,871,634, which is incorporated herein by reference with regard to the definitions for and descriptions of toluene equivalence, solubility number ($S_{BN}$), and insolubility number ($I_N$).

For the toluene equivalence test, the procedure specified in AMS 79-004 and/or as otherwise published (e.g., see Griffith, M. G. and Siegmund, C. W., "Controlling Compatibility of Residual Fuel Oils," *Marine Fuels*, ASTM STP 878, C. H. Jones, Ed., American Society for Testing and Materials, Philadelphia, 1985, pp. 227-247, which is hereby incorporated by reference herein) is defined as providing the procedure. Generally, a convenient volume ratio of oil to a test liquid mixture can be selected, such as about 2 grams of fuel oil (with a density of about 1 g/ml) to about 10 ml of test liquid mixture. Then various mixtures of the test liquid mixture can be prepared by blending n-heptane and toluene in various known proportions. Each of these can be mixed with the fuel oil at the selected volume ratio of oil to test liquid mixture. A determination can then be made for each oil/test liquid mixture to determine if the asphaltenes are soluble or insoluble. Any convenient method might be used. One possibility can be to observe a drop of the blend of test liquid mixture and oil between a glass slide and a glass cover slip using transmitted light with an optical microscope at a magnification from ~50× to ~600×. If the asphaltenes are in solution, few, if any, dark particles will be observed. If the asphaltenes are insoluble, many dark, usually brownish, particles, usually ~0.5 microns to ~10 microns in size, can be observed. Another possible method can be to put a drop of the blend of test liquid mixture and oil on a piece of filter paper and let it dry. If the asphaltenes are insoluble, a dark ring or circle will be seen about the center of the yellow-brown spot made by the oil. If the asphaltenes are soluble, the color of the spot made by the oil will be relatively uniform in color. The results of blending oil with all of the test liquid mixtures can then be ordered according to increasing percent toluene in the test liquid mixture. The desired TE value can be between the minimum percent toluene that dissolves asphaltenes and the maximum percent toluene that precipitates asphaltenes. Depending on the desired level of accuracy, more test liquid mixtures can be prepared with percent toluene amounts in between these limits. The additional test liquid mixtures can be blended with oil at the selected oil to test liquid mixture volume ratio, and determinations can be made whether the asphaltenes are soluble or insoluble. The process can be continued until the desired value is determined within the desired accuracy. The final desired TE value can be taken as the mean of the minimum percent toluene that dissolves asphaltenes and the maximum percent toluene that precipitates asphaltenes.

The above test method for the toluene equivalence test can be expanded to allow for determination of a solubility number ($S_{BN}$) and an insolubility number ($I_N$) for a fuel oil sample. If it is desired to determine $S_{BN}$ and/or $I_N$ for a fuel oil sample, the toluene equivalence test described above can be performed to generate a first data point corresponding to a first volume ratio $R_1$ of fuel oil to test liquid at a first percent of toluene $T_1$ in the test liquid at the TE value. After generating the TE value, one option can be to determine a second data point by a similar process but using a different oil to test liquid mixture volume ratio. Alternatively, a percent toluene below that determined for the first data point can be selected and that test liquid mixture can be added to a known volume of the fuel oil until asphaltenes just begin to precipitate. At that point the volume ratio of oil to test liquid mixture, $R_2$, at the selected percent toluene in the test liquid mixture, $T_2$, can be used the second data point. Since the accuracy of the final numbers can increase at greater distances between the data points, one option for the second test liquid mixture can be to use a test liquid containing 0% toluene or 100% n-heptane. This type of test for generating the second data point can be referred to as the heptane dilution test.

Based on the toluene equivalence test and heptane dilution test (or other test so that $R_1$, $R_2$, $T_1$, and $T_2$ are all defined), the insolubility and solubility numbers for a sample can be calculated based on Equations (2) and (3).

$$I_N = T_2 - \left[\frac{T_2 - T_1}{R_2 - R_1}\right]R_2 \quad (2)$$

$$S_{BN} = I_N[1 + 1/R_2] - T_2/R_2 \quad (3)$$

As noted in U.S. Pat. No. 5,871,634, alternative methods are available for determining the solubility number of a fuel oil that has an insolubility number of zero.

In this discussion, some $S_{BN}$ and $I_N$ values were determined according to the above procedure. Other $S_{BN}$ and $I_N$ values were determined by calculation based on values measured according to ASTM D7157. For purposes of determining the scope of this description, the calculation described in section 4.2 of the Concawe Report No. 11/19 for determining $S_{BN}$ and $I_N$ should be used. As described in section 4.2 of Concawe Report No. 11/19, ASTM D7157 can be used to determine the parameters "S-value" and "$S_a$". Based on those parameters, $I_N$ and $S_{BN}$ can be calculated according to Equations 1 and 2, where $d_{15}$ is the density at 15° C. in kg/m$^3$.

$$I_N = 100 \times (1 - S_a) \quad (1)$$

$$S_{BN} = I_N \times [1 + (S\text{-value} - 1) \times d_{15}/1000] \quad (2)$$

The sediment generated by a fraction can be characterized according to ISO 10307-2, Procedure A.

Definitions

All numerical values within the detailed description and the claims herein are modified by "about" or "approximately" the indicated value, and take into account experimental error and variations that would be expected by a person having ordinary skill in the art.

Unless otherwise specified, for resid-containing fractions, distillation points and boiling points can be determined according to ASTM D7169. For other fractions, distillation points and boiling points can be determined according to ASTM D2887, but for samples that are not susceptible to characterization using ASTM D2887, D7169 can be used.

A distillate boiling range fraction is defined as a fraction having a T10 distillation point of 140° C. or more and a T90 distillation point of 565° C. or less. A vacuum gas oil boiling range fraction (also referred to as a heavy distillate) can have a T10 distillation point of 350° C. or higher and a T90 distillation point of 535° C. or less. A vacuum resid is defined as a bottoms fraction having a T10 distillation point of 400° C. or higher. An atmospheric resid is defined as a bottoms fraction having a T10 distillation point of 149° C. or higher, or 350° C. or higher. In some aspects, an atmospheric resid can have a T90 distillation point of 550° C. or more, or 565° C. or more.

A resid-containing fraction is defined as a fraction that includes bottoms, and therefore can contain materials including but not limited to: a vacuum resid (also referred to as vacuum tower bottoms) and/or an atmospheric resid (also referred to as atmospheric tower bottoms), main column bottoms (also referred to as cat slurry or FCC bottoms), steam cracker tar, visbreaker tar, any residue material derived from low sulfur crude slates, LSFO, RSFO, or other LSFO/RSFO blend stocks, as well as any of the above materials that have undergone hydroprocessing to reduce sulfur content. A resid-containing fraction may additionally contain distillate flux to improve handling characteristics that facilitate movement and blending in a petroleum refinery. Such a resid-containing fraction containing distillate flux may be referred to as a "fluxed resid fraction." Resid-containing fraction and fluxed resid fraction may be used interchangeably in the specification and the claims. It is noted that the definitions for distillate boiling range fraction, atmospheric resid, and vacuum resid are based on boiling point only. Thus, a distillate boiling range fraction or a resid-containing fraction (such as an atmospheric resid-containing fraction or a vacuum resid-containing fraction) can include components that did not pass through a distillation tower or other separation stage based on boiling point. A shale oil distillate boiling range fraction is defined as a shale oil fraction corresponding to the distillate boiling range. A shale oil atmospheric resid is defined as a shale oil bottoms fraction corresponding to an atmospheric resid. A shale oil vacuum resid is defined as a shale oil bottoms fraction corresponding to a vacuum resid.

With regard to characterizing properties of resid boiling range fractions and/or blends of such fractions with other components to form resid boiling range fuels, a variety of methods can be used. Density of a blend at 15° C. (kg/m$^3$) can be determined according ASTM D4052. Sulfur (in wppm or wt %) can be determined according to ASTM D2622, while nitrogen (in wppm or wt %) can be determined according to D5291. Kinematic viscosity at 40° C., 50° C., and/or 100° C. can be determined according to ASTM D445. Pour point can be determined according to ASTM D97. Micro Carbon Residue (MCR) content can be determined according to ASTM D4530. The content of n-heptane insolubles can be determined according to ASTM D3279. CCAI is a calculated value that can be derived from other measured quantities. Flash point can be determined according to ASTM D93. The metals content can be determined according to IP 501. Aromatics content can be determined according to D5186. (It is noted that some aromatics contents reported in this discussion were alternatively determined by using 2-dimensional gas chromatography.)

Categories of Fuels

A fuel is a gaseous, liquid, or solid material used as an energy source for combustion devices, including but not limited to combustion engines in land-based, aeronautical, or marine vehicles, combustion engines in generators, furnaces, boilers, and other combustion devices that are used to provide heat or power. A fuel composition is understood to refer to a gaseous, liquid, or solid material that can be used as a fuel. For certain combustion devices, proper combustion or operation of the combustion device may be ensured by controlling fuel properties. The necessary properties of a fuel for specific combustion devices may be specified in standard specification documents. In order to be suitable for its end use application in a combustion engine or other combustion device, a gaseous, liquid, or solid material may require the addition of one or more fuel additives. Fuels may be derived from renewable or conventional sources, or a combination of both. A blend of one or more fatty acid alkyl esters with a resid-containing fraction can be referred to as a fuel composition.

A fuel blending component is a liquid fraction that can be used to form a fuel. In some cases fuel blending components may possesses the appropriate properties for use in a combustion device without further modification. Fuel blending components may be combined (blended) with fuels, other fuel blending components, or fuel additives to form a finished fuel or fuel composition that possesses the appropriate properties for use in a combustion device. Fuel blending components may be derived from renewable or conventional sources.

A conventional fuel is a fuel or fuel composition derived from one or more conventional fuel blending components. Conventional fuel blending components are derived from conventional hydrocarbon sources such as crude oil, natural gas, liquid condensates, heavy oil, shale oil, and oil sands, as described in ASTM D4175.

A renewable fuel is a fuel or fuel composition derived from one or more renewable fuel blending components. Renewable fuel blending components are derived from naturally-replenishing energy sources, such as biomass, water, and electricity produced from hydropower, wind, solar, or geothermal sources. Biofuels are a subset of renewable fuels manufactured from biomass-derived feedstocks (e.g. plant or animal based materials). Examples of biofuels include, but are not limited to, fatty acid methyl esters and hydrotreated vegetable oils. The distillate boiling range fraction of a hydrotreated vegetable oil (HVO) is also referred to as renewable diesel.

Conventional fuel blending components and renewable fuel blending components may be combined to form a fuel or fuel composition. The renewable (biomass-based) carbon content of fuels or fuel blending components from conventional and renewable sources can be measured using radiocarbon methods based on $^{14}C$ analysis, such as ASTM D6866 and EN 16640. Fatty acid methyl ester content in fuels or fuel blending components can be measured using methods such as IP 579 and ASTM D7963. For a fuel or fuel blending component containing multiple renewable fractions, such as fatty acid methyl ester and a secondary renewable fraction (for example hydrotreated vegetable oil), the presence of one or multiple renewable fractions and the relative proportion of fatty acid methyl ester versus other renewable fractions can be assessed by subtraction of the fatty acid methyl ester content determined by IP 579 or ASTM D7963, from a total renewable carbon content determined by ASTM D6866 or EN 16640.

A conventional distillate is a conventional liquid fuel from an overhead or side stream of a distillation process and does not contain residual bottoms. Light distillates boil below 250° C., middle distillates boil between 150° C. and 400° C., and heavy distillates boil above 350° C. A renewable distillate is a renewable liquid whose boiling range fits within the range of conventional distillate fuels.

Distillate flux, also referred to as "flux", is a distillate fraction that is blended with a residual fraction to form a residual fuel composition. "Total flux" collectively refers to all distillate fractions blended into a residual fuel composition. Total flux may include multiple distillate fluxes from conventional sources or renewable sources. A conventional distillate flux is a conventional distillate blended into a residual fuel composition, and examples include diesels, gas oils, kerosenes, cycle oils, and non-renewable gas-to-liquid hydrocarbons. A renewable distillate flux is a renewable distillate blended into a residual fuel composition. Examples of renewable distillate fluxes include fatty acid alkyl esters, synthetic renewable hydrocarbons such as gas-to-liquid hydrocarbons from renewable synthesis gas (from gasification of biomass, municipal solid waste, or other renewable feedstocks), hydrotreated natural fats or oils (such as hydrotreated vegetable oil including soy oil, canola oil, rapeseed oil, etc., or hydrotreated animal oils and fats such as fish oils, chicken fat or beef tallow), hydrotreated waste cooking oils, hydrotreated tall oil, etc., and pyrolysis gas oils.

A hydrocarbon is a compound composed only of hydrogen and carbon atoms, and an oxygenate is an oxygen-containing organic compound, such as for example ethers (diethyl ether, methyl t-butyl ether) or alcohols (methanol, ethanol) or esters or acids or carboxylic acids (fatty acids, resin acids) or cyclic oxygenates (sugars, C6 lignin derivatives) or combinations thereof.

As described in ASTM D4175, hydrocarbon and oxygenate fuels consist primarily of hydrocarbon and oxygenate compounds, respectively, but may also contain impurities and contaminants from the fuel's raw materials and manufacturing processes.

Life Cycle Assessment and Carbon Intensity

Life cycle assessment (LCA) is a method of quantifying the "comprehensive" environmental impacts of manufactured products, including fuel products, from "cradle to grave". Environmental impacts may include greenhouse gas (GHG) ($CO_2$eq or $CO_2$ equivalent) emissions, freshwater impacts, land impacts, or other impacts on the environment associated with the finished product. The general guidelines for LCA are specified in ISO 14040. Guidelines for LCA specifically for the transportation sector are specified in EN 16258. Additionally, governmental regulations may dictate guidelines for LCA, such as Directive 2009/30/EC of the European Parliament and of the Council.

The "carbon intensity" of a fuel product (e.g. residual fuel) is often defined as the life cycle GHG ($CO_2$) emissions associated with that product (kg $CO_2$eq) relative to the energy content of that fuel product (MJ, LHV basis). Life cycle GHG emissions associated with conventional petroleum-based fuel products must include GHG emissions associated with crude oil production; crude oil transportation to a refinery; refining of the crude oil; transportation of the refined product to point of "fill"; and combustion of the fuel product.

Life cycle GHG emissions associated with the stages of life cycles for fuels are calculated as follows, according to the methodology defined in Directive 2009/30/EC of the European Parliament and of the Council Annex IV, Part C.

(1) $e_{ec}$, GHG emissions associated with extraction or cultivation of raw materials. For a renewable product, these raw materials generally include plant or animal derived materials.

(2) $e_l$, annualized GHG emissions derived from carbon stock changes caused by land use change. These emissions shall be annualized by dividing the total emissions equally over 20 years.

(3) $e_p$, GHG emissions derived from processing raw materials to manufacture a renewable product suitable for use as a transportation fuel or blending component for a transportation fuel. Relevant emissions-generating processes include: extraction or cultivation of raw materials, collection of raw materials, from waste and leakages, and emissions from the production of chemicals or products used in extraction or cultivation.

(4) $e_{td}$, GHG emissions from rail, pipeline, truck, barge, or other forms of transportation necessary for production and distribution. This includes emissions from transport and storage of raw, semi-finished, and finished materials.

(5) $e_u$, GHG emissions associated with use of the fuel. Relevant uses may include combustion in an engine or boiler. This value is taken to be zero for biofuels.

(6) esca, GHG emission savings associated with soil carbon accumulation via improved agricultural management.

(7) $e_{ccs}$, GHG emission savings associated with carbon capture and geological storage.

(8) $e_{ccr}$, GHG emissions savings associated with carbon capture and replacement.

(9) $e_{ee}$, GHG emissions savings associated with excess electricity from cogeneration.

The total life cycle GHG emissions for a renewable fuel or fuel blending component, E, can be calculated as:

$$E=e_{cc}+e_l+e_p+e_{td}+e_u-e_{sca}-e_{ccs}-e_{ccr}-e_{ee}$$

The total life cycle GHG emissions, E, are expressed in terms of grams of $CO_2$ equivalent per MJ of fuel, abbreviated to $gCO_2eq/MJ$.

In the above methodology, the dominant contribution for the amount of $CO_2$ produced per MJ of fossil or conventional fuels is the $CO_2$ formed during combustion of the product ($e_u$). Because the $CO_2$ generated during combustion is such a high percentage of the total carbon intensity, achieving even small or incremental reductions in carbon intensity has traditionally been challenging.

However, because renewable blending components (such as hydrotreated vegetable oils and fatty acid alkyl esters) are derived from biological sources (and therefore consume some $CO_2$ during growth of the original biological material), the GHG emissions from combustion of the renewable blending components are offset by the $CO_2$ absorbed during the plant growth. Therefore, the above methodology states that $e_u$ is taken to be zero for biofuels, which can result in a substantially lower life cycle carbon intensity than conventional distillate fractions.

Additionally, reduced carbon intensity from renewable blending components or a blend of renewable blending components and conventional blending components can be expressed in comparison to the carbon intensity of conventional fuels and blending components.

Part C of Directive 2009/30/EC of the European Parliament and of the Council Annex IV prescribes a methodology to calculate carbon intensity reduction (greenhouse gas emission savings) for a renewable fuel or renewable blending component, relative to a comparator. Generally the comparator would be a conventional fuel or a conventional blending component.

According to Part C of Directive 2009/30/EC of the European Parliament and of the Council Annex IV, greenhouse gas emissions savings from renewable fuels and fuel blending components shall be calculated de novo as:

$$\text{SAVING}=(E_F-E_B)/E_F, \text{ where}$$

$E_B$=total emissions from the biofuel, and $E_F$=total emissions from the fossil fuel (conventional fuel)

Total emissions of the conventional comparator fuel ($E_F$) can be calculated de novo using an appropriate methodology, or published pre-calculated values may be used, which are provided in EN 16258—"Methodology for calculation and declaration of energy consumption and GHG emissions of transport services (freight and passengers)." Specifically, EN 16258 Table A.1 provides full life cycle ("well-to-wheels") GHG emissions for a variety of conventional fuels, described as "GHG emissions factors," in units of g $CO_2$eq/MJ, kg $CO_2$e/kg, or kg $CO_2$eq/liter.

The accuracy of de novo calculation of reduced carbon intensity for renewable blending components can be certified by International Sustainability and Carbon Certification or similar certifying organizations.

In addition to de novo calculation, pre-calculated, published greenhouse gas emission savings can be used for life cycle analysis. For example, Directive 2009/30/EC of the European Parliament and of the Council Annex IV, Part A, provides both typical and default greenhouse gas emission savings (carbon intensity reductions) associated with various renewable blending components. Typical and default greenhouse gas emissions savings can be converted to carbon intensity values using a fossil fuel comparator, $E_F$, provided in Directive 2009/30/EC of the European Parliament and of the Council Annex IV, Part C, which is 83.8 $gCO_2eq/MJ$.

NOx Emissions

Exhaust gases, also called emissions, are the mixture of various types of gaseous and microscopic particulate compounds formed as a byproduct of combustion of fuel in an engine or other combustion device, such as combustion of diesel fuel or marine fuel in a compression ignition (diesel) engine. An example of gaseous compounds created by fuel combustion are oxides of nitrogen, including NO and $NO_2$, which are collectively referred to as "NOx emissions," see US EPA Technical Bulletin "Nitrogen oxides (NOx), why and how they are controlled," EPA456/F-99-006R, November 1999. NOx emissions in exhaust gases from a marine vessel can be measured using a portable emissions analyzer unit such as the Model 900503 5 Gas Analyzer (CO, $CO_2$, HC, $O_2$, NOx) by Bridge Analyzer or similar equipment. The concentration of NOx in exhaust emissions may be expressed as parts per million (ppm) of NOx in the sampled gases.

Particulate Matter Emissions

Particulate matter (PM) emissions are also present in exhaust gases, created as a byproduct of combustion processes. Particulate matter emissions are composed of microscopic solid particles or liquid droplets. Examples of particulate matter emissions include, but are not limited to, smoke, soot, and black carbon. Some particulate matter emissions consist of particles of such a size that they may be readily observed by the human eye as a haze or smoke suspended in the air. The general principles of particulate matter emissions are explained by the US EPA, see the US EPA "Particulate Matter (PM) Basics" website, https://www.epa.gov/pm-pollution/particulate-matter-pm-basics#PM. Particulate matter emissions consisting of particles of such a size that they may be readily observed by the human eye as a haze or smoke suspended in the air can also be captured visually by standard digital photography methods. Particulate matter emissions in exhaust gases may be quantified according to "particle number," a measure of the number of discrete particles per volume of a sampled gas (particles/$cm^3$). Particle number can be determined using a specialized instrument to count discrete microscopic particles in exhaust gases, such as the TSI Nanoparticle Emission Tester (NPET) Model 3795, High-Concentration Nanoparticle Emission Tester, or similar equipment.

Water Affinity and Microbiological Growth Characterization

Marine fuel may also contain dissolved and free water. Water and fuel oil are not miscible, but a small amount of dissolved water may be present in the fuel phase. Free water is present as a separate liquid phase and commonly takes the form of small entrained water droplets or a distinct water layer. Water in fuel may be measured by Karl Fischer coulometric titration (ISO 3733 or ASTM 95). Temperature fluctuations in storage and use in the vessel allow the fuel to absorb water and later shed it, converting dissolved water into free water in the fuel system. Centrifugal purifiers on board the vessel are used to remove most free water before the engine.

Water affinity refers to the tendency of fuel to hold dissolved and entrained water in the fuel phase. Fuels with low water affinity more easily shed water, while fuels with high water affinity can support higher amounts of dissolved and entrained free water. Fuels with high water affinity characteristics may pose a higher risk for operation and handling issues onboard the marine vessel. The water affinity performance of fuels can be assessed by mixing fuel with sterile water, shaking the mixture, allowing the mixture to settle for a period of 24 hours, and measuring the water content of the fuel at different depths. Suggested fuel to water ratios are 1000:1, 500:1, 100:1, and 10:1.

The presence of free water content is linked to microbiological growth, with microbes growing preferentially at the fuel-water interface. There are many factors that affect the risk and severity of a microbial outbreak, such as the fuel chemistry, fuel impurities, operating conditions including temperature, and fuel housekeeping practices. A fuel's inherent susceptibility to microbial attack can be assessed by seeding samples taken from fuel and water mixtures with microbes isolated from spoiled fuel samples and observing their growth over time under optimal conditions. Microbes can include bacteria, yeast, mold, and sulfur-reducing bacteria. They are typically measured in fuel or in water phases by culturing a sample, counting individual colonies, and scaling colony-forming units per milliliter or liter of sample (cfu/mL or cfu/L). Accurate quantification may require serial dilution to allow counting of distinct colonies. Standardized methods include ASTM D7978 and IP 613.

The following are examples of the present disclosure and are not to be construed as limiting.

EXAMPLES

Comparative Blending Examples—Conventional Resid-containing Fuel Oils

FIG. 1 shows various properties for two fuel oils (Fuel Oils 1 and 2, or FO1 and FO2), four types of conventional distillate fractions, and two renewable diesel fractions. The conventional distillate fractions represent low sulfur diesel blending components for forming a marine fuel oil from a resid-containing fraction. The renewable diesel fractions correspond to diesel formed from hydrotreated vegetable oil. FO1 and FO2 represent conventional resid fractions that could be used in a marine fuel oil, but only if blended with appropriate blend components. For example, the density of FO1, the kinematic viscosity of FO1 and FO2, and the sulfur level of FO2 are too high for some types of residual fuels. Conventionally, this could be corrected by blending FO1 or FO2 with some type of flux, such as one of the distillate or renewable diesel fractions shown in FIG. 1.

In FIG. 1, Distillate 1, Distillate 2, Distillate 3, and Distillate 4 are distillate fractions that have BMCI values near 30, while the renewable diesel fractions have BMCI values near 0. This is in contrast to FO1 and FO2, which have BMCI values of greater than 60. With regard to toluene equivalence (TE), FO1 has a TE number of 73, which is roughly 10 lower than the BMCI value for FO1. FO2 has a TE number of 41, which is roughly 20 lower than the BMCI value for FO2. None of the distillate fractions or renewable diesel fractions has a TE greater than 0.

FIG. 1 also shows $S_{BN}$ and $I_N$ for the various fractions. As shown in FIG. 1, FO1 has a $S_{BN}$ of 100 and an $I_N$ of 78, and FO2 has a $S_{BN}$ of 57 and an $I_N$ of 33. The distillate fractions have $S_{BN}$ values near 30, with an $I_N$ of 0. It is noted that based on both BMCI−TE and $S_{BN}$−$I_N$, FO1 would be considered a challenging resid fraction for forming a marine fuel oil, as FO1 is already close to the compatibility limit for avoiding sediment formation.

In order to correct the density and kinematic viscosity of FO1 to levels that satisfy some residual fuel specifications, FO1 would need to be blended in a roughly 80/20 volume ratio with a distillate boiling range flux. Table 1 shows calculated properties for blends formed by blending FO1 with each of the distillate or renewable diesel fractions shown in FIG. 1 in an 80/20 volume ratio.

TABLE 1

| Resid Blends with 20 vol % Distillate | | | | | | | | |
|---|---|---|---|---|---|---|---|---|
| Test | Method | Unit | FO1 | FO1 + 20% Dist1* | FO1 + 20% Dist2* | FO1 + 20% Dist3* | FO1 + 20% RD1* | FO1 + 20% RD2* |
| Density @ 15° C. | D4052 | g/cm$^3$ | 1.010 | 0.983 | 0.979 | 0.975 | 0.963 | 0.967 |
| Kinematic Viscosity (KV) @ 50° C. | D445 | mm$^2$/s | 473.0 | 161.5 | 111.8 | 92.5 | 79.3 | 94.7 |
| CCAI | Calculated | — | 868 | 853 | 853 | 852 | 843 | 844 |
| Carbon Residue, Micro | D4530 | wt % | 19.20 | 15.8 | 15.8 | 15.9 | 16.1 | 16.0 |
| BMCI | Calculated | — | 83.4 | 73.3 | 72.7 | 72.0 | 66.4 | 67.6 |
| Toluene Equivalence (TE) | AM-S 79-004 | — | 73 | 72.5 | 72.5 | 73 | 73 | 73 |
| BMCI − TE | — | — | 10.9 | 0.8 | 0.2 | −0.5 | −6.1 | −4.9 |
| Oil Compatibility Test | AM-S 1999-011 | | | | | | | |
| Solubility blending number ($S_{BN}$) | | — | 100 | 86 | 86 | 85.2 | | |
| Incompatibility number ($I_N$) | | — | 78 | 78 | 78 | 78 | | |
| $S_{BN} - I_N$ | | — | 22 | 8 | 8 | 7.2 | | |

*Estimated values

As shown in Table 1, the calculated blends including FO1 and 20% of the various distillate/renewable diesel fractions all have a density and kinematic viscosity that is roughly suitable for satisfying some residual marine fuel specifications. However, the resulting blends also have BMCI–TE values near 0 or even below 0. This indicates a high likelihood of sediment formation, meaning that the resulting blend does not meet all specifications from, for example, a residual fuel oil specification in ISO 8217. It is noted that the difference between $S_{BN}$ and $I_N$ for the three distillate blends also indicates a blend that will result in sediment formation.

Table 2 shows calculated blends that are similar to Table 1, but with 50 vol % of each distillate/renewable diesel fraction, rather than 20 vol %. As shown in Table 2, all of the blends including 50 vol % of distillate or renewable diesel have negative values for BMCI–TE, indicating a high likelihood of sediment formation. The negative values for $S_{BN}$–$I_N$ for the three distillate blends also indicate the blends will likely result in sediment formation.

TABLE 2

Resid Blends with 50 vol % Distillate

| Test | Method | Unit | FO1 | FO1 + 50% Dist1* | FO1 + 50% Dist2* | FO1 + 50% Dist3* | FO1 + 50% RD1* | FO1 + 50% RD2* |
|---|---|---|---|---|---|---|---|---|
| Density @ 15° C. | D4052 | g/cm$^3$ | 1.010 | 0.943 | 0.932 | 0.923 | 0.894 | 0.903 |
| Kinematic Viscosity (KV) @ 50° C. | D445 | mm$^2$/s | 473.0 | 44.83 | 23.02 | 16.71 | 13.05 | 17.38 |
| CCAI | Calculated | — | 868 | 831 | 831 | 828 | 804 | 807 |
| Carbon Residue, Micro | D4530 | wt % | 19.20 | 10.3 | 10.4 | 10.5 | 10.8 | 10.7 |
| BMCI | Calculated | — | 83.4 | 58.2 | 56.7 | 55.0 | 40.9 | 44.0 |
| Toluene Equivalence (TE) | AM-S 79-004 | — | 73 | 73 | 73 | 73 | 73 | 73 |
| BMCI − TE | — | — | 10.9 | −14.4 | −15.9 | −17.6 | −31.6 | −28.5 |
| Oil Compatibility Test | AM-S 1999-011 | | | | | | | |
| Solubility blending number ($S_{BN}$) | | — | 100 | 65 | 65 | 63 | | |
| Incompatibility number ($I_N$) | | — | 78 | 78 | 78 | 78 | | |
| $S_{BN} - I_N$ | | — | 22 | −13 | −13 | −15 | | |

*Estimated values

In order to correct the kinematic viscosity and sulfur of FO2 to a level that satisfies some residual fuel specifications, FO2 would need to be blended with a distillate boiling range flux. Table 3 shows properties for model blends formed by blending FO2 with Distillate 4 from FIG. 1 in a 50/50 volume ratio and by blending FO2 with Renewable Diesel 1 from FIG. 1 in a 67/33 volume ratio. As shown in Table 3, both blends have values for BMCI–TE well below 15, indicating a high likelihood of sediment formation. The $S_{BN}$–$I_N$ values well below 20 also indicate blends that will result in sediment formation. Additional modeled blends with conventional distillate flux that have similar blend properties are shown in FIG. 13. Hand blends were created for the blends in Table 3, and partial data is shown in FIG. 12. The blend with Renewable Diesel 1 had performance consistent with that predicted in Table 3, with a TSP of 0.16 wt %. However, the blend with Distillate 4 did not produce sediment (TSP<0.01 wt %) despite the predicted $S_{BN}$–$I_N$ values well below 20.

TABLE 3

Additional Resid Blends with Distillate

| Test | Method | Unit | FO2 | FO2 + 50% Dist4* | FO2 + 33% RD1* |
|---|---|---|---|---|---|
| Density @ 15° C. | D4052 | g/cm$^3$ | 0.9720 | 0.9049 | 0.9079 |
| Kinematic Viscosity (KV) @ 50° C. | D445 | mm$^2$/s | 1238 | 21.30 | 47.24 |
| CCAI | Calculated | — | 822 | 806 | 795 |
| Sulfur | ISO 8754 | wt % | 0.58 | 0.31 | 0.42 |
| Carbon Residue, Micro | D4530 | wt % | 11.2 | 6.0 | 8.0 |

TABLE 3-continued

| Additional Resid Blends with Distillate | | | | | |
|---|---|---|---|---|---|
| Test | Method | Unit | FO2 | FO2 + 50% Dist4* | FO2 + 33% RD1* |
| Heptane Insolubles | D3279 | wt % | 4.3 | 2.3 | 3.1 |
| BMCI | Calculated | — | 63.8 | 47.1 | 42.2 |
| Toluene Equivalence (TE) | AM-S 79-004 | — | 41 | 41 | 41 |
| BMCI - TE | — | — | 22.8 | 6.1 | 1.2 |
| Compatibility - Rofa Test | ASTM D7157 | | | | |
| S-value | | — | 1.74 | | |
| $S_a$ | | — | 0.67 | | |
| S0 | | — | 0.57 | | |
| $R^2$ | | — | 1.00 | | |
| Solubility blending number ($S_{BN}$) | | — | 57 | 44 | 38 |
| Incompatibility number ($I_N$) | | — | 33 | 33 | 33 |
| SBN - $I_N$ | | — | 24 | 11 | 5 |
| Total Sediment Potential (TSP) | ISO 10307-2 thermal aging | wt % | | | |
| Spot Test - Cleanliness Rating | D4740 | — | | | |

*Estimated values

Inventive Blending Examples—Blends of Resid-Containing Fractions with Fatty Acid Alkyl Esters The following examples use fatty acid methyl esters (FAME) to illustrate the benefits of using fatty acid alkyl esters as blend components for forming marine residual fuels.

FIG. 2 shows properties for various fatty acid methyl ester (FAME) fractions and several fuel oils. It is noted that FO1 and FO2 in FIG. 2 are the same as FO1 and FO2 from FIG. 1 and Tables 1 and 2. As shown in FIG. 2, the FAME fractions have BMCI values of roughly 40 or less. This is similar to the BMCI values of roughly 30 for the distillate fractions. However, it has been discovered that fatty acid alkyl ester fractions have unexpectedly high $S_{BN}$ values. As shown in FIG. 2, the FAME fractions have $S_{BN}$ values between 65 and 120. Normally, a fraction with a BMCI of 40 or less would be expected to also have a $S_{BN}$ value of 50 or less.

As described above, FO1 has a relatively low BMCI–TE value and low difference value between $S_{BN}$ and $I_N$. Thus, FO1 is a resid fraction that would be expected to present challenges when attempting to blend with a distillate flux. FO2 and FO3 also have low values for BMCI–TE and $S_{BN}$–$I_N$. It is noted that FO3 has a spot test cleanliness rating (ASTM D4740) of 1. FO4 is potentially more suitable for blending, but still has the potential for incompatibility when blended with larger amounts of conventional distillate.

FIG. 3 shows a blended product made from each of the FAME fractions in FIG. 2 in combination with FO1, FO2, or FO3. The blended products in FIG. 3 correspond to 80 vol % of FO1, FO2, or FO3 blended with 20 vol % of one of the FAME fractions. The BMCI for each blended product was calculated based on the weighted average of the BMCI values for the resid-containing fraction and the FAME fraction. The Toluene Equivalence, however, was measured for each blended product.

As shown in FIG. 3, each of the blended products with FO1 and FO3 in FIG. 3 has a BMCI–TE value of less than 15. This indicates that these blended products in FIG. 3 would be expected to have sediment formation. In addition, the blend with FO2 has a BMCI–TE value of less than 16 and is expected to be marginally stable. However, as shown for the blends involving FO2 and FO3, the measured sediment formation was 0.01 wt % or lower. Additionally, the blends involving FO3 and FAME 1, FAME 2, or FAME 3 all maintained a spot test cleanliness rating (ASTM D4740) of 1. This demonstrates the unexpected benefit of blending a fatty acid alkyl ester fraction with a resid-containing fraction for forming marine fuel oils. This unexpected benefit is due in part to the high $S_{BN}$ values for the FAME fractions. As shown in FIG. 3, the solubility blending number for each of the blended fractions is equal to or greater than the corresponding solubility blending number for the resid-containing fraction used to form the blend. In fact, based on the solubility blending number values, the addition of the fatty acid alkyl ester fractions appears to stabilize the resulting blends.

FIG. 4 shows another series of blended products based on blending FO2 with FAME 5 and blending FO4 with FAME 1, FAME 2, and FAME 3. For the blended products in FIG. 4, 50 vol % of FO2 or FO4 was blended with 50 vol % of a FAME fraction. Although FO4 has a large value for BMCI–TE of 31.8, it would be expected conventionally that attempting to blend FO4 with 50 vol % of a distillate flux would result in sediment formation. For example, the most favorable distillate fraction for blending shown in Table 1 above is Distillate 1, which has a BMCI value of 32.9. Based on calculated values, a blend of 50 vol % FO4 and 50 vol % Distillate 1 would be expected to have a BMCI value of 53.9. The calculated TE value for such a blend would be expected to be roughly the TE value for FO4 of 43. Thus, a blend of 50 vol % FO4 and 50 vol % Distillate 1 would have a calculated BMCI–TE value of roughly 11, which is less than 15 (or less than 12) and therefore indicates a blend that would likely be incompatible. Compared to FO4, FO2 has a smaller value for BMCI–TE of 22.8, suggesting that FO2 is more likely than FO4 to form incompatible blends.

As shown in FIG. 4, the calculated BMCI–TE values for the blended fractions are all less than 15, indicating a likelihood for sediment formation. The blend with FO2 has an even lower BMCI–TE value of 3.8. However, the measured sediment formation for the blended fractions was either 0.01 wt % or less than 0.01 wt % indicating that the blended fractions would satisfy the sediment formation requirement for various types of marine fuel oils. Due to the high $S_{BN}$ value for FO4 (79), the blend of FO4 with FAME 1 had a lower $S_{BN}$ value (73) than the neat $FO_4$ fraction. This was the blended product that showed 0.01 wt % of sediment formation. It is noted that the blends of FO2 with FAME 5 and blends of FO4 with FAME 2 and FAME 3 had $S_{BN}$ values (86, 82, and 79, respectively) that were equal to or greater than the $S_{BN}$ value of the corresponding neat FO2 or FO4 fraction. This represents another unexpected benefit of using fatty acid methyl esters (or more generally fatty acid alkyl esters) as a blend component. Due to the unusually high $S_{BN}$ values, blending fatty acid methyl esters (or more generally fatty acid alkyl esters) with some resid-containing fractions can provide the unexpected benefit of reducing density and kinematic viscosity while also maintaining or even improving the compatibility of the resulting blend. This is in contrast to conventional addition of flux to a resid-containing fraction, where it would be expected that addition of flux would provide the traditional benefit of reducing density and/or kinematic viscosity, but at the cost of also reducing the compatibility of the resulting blend.

Based on the unexpectedly high $S_{BN}$ values of fatty acid alkyl esters, still greater amounts of fatty acid alkyl ester can be blended with a resid-containing fraction without causing sediment formation in the resulting blended product. Table 4 shows a modeled blending example of blending FO3 with FAME 1 in a volume ratio of 30 vol % FO3 to 70 vol % FAME 1.

TABLE 4

Model Blend with 70 vol % Fatty Acid Alkyl Ester

| Test | Method | Unit | FO3 | FO3 + 70% FAME 1* |
|---|---|---|---|---|
| Density @ 15° C. | D4052 | g/cm$^3$ | 0.963 | 0.905 |
| Kinematic Viscosity (KV) @ 50° C. | D445 | mm$^2$/s | 217.3 | 8.40 |
| Distillation - Average Boiling Point | D7169 | ° C. | 483 | |
| CCAI | Calculated | — | 830 | 826 |
| Sulfur | ISO 8754 | wt % | 0.48 | 0.15 |
| Carbon Residue, Micro | D4530 | wt % | 6.16 | 2.0 |
| Asphaltenes | IP 143 | wt % | 1.8 | 0.6 |
| BMCI | Calculated | — | 64.1 | 46.6 |
| Toluene Equivalence (TE) | AM-S 79-004 | — | 43 | 43 |
| BMCI - TE | — | — | 21.1 | 3.6 |
| Oil Compatibility Test | AM-S 1999-011 | | | |
| Solubility blending number ($S_{BN}$) | | — | 61 | 81 |
| Incompatibility number ($I_N$) | | — | 38 | 38 |
| $S_{BN}$ - $I_N$ | | — | 23 | 43 |

*Estimated values

As shown in Table 4, the modeled blend of 30 vol % FO3 and 70 vol % FAME 1 has a predicted BMCI−TE value of 3.6. For a conventional blend, this would indicate that sediment formation was likely. However, due to the high $S_{BN}$ value of FAME 1, the modeled blend in Table 4 has a higher $S_{BN}$ value than the neat FO3 fraction. As a result, even though the model blend in Table 4 shows addition of 70 vol % of FAME 1 to FO3, the model blend has a $S_{BN}$−$I_N$ value above 40, indicating no sediment formation.

Inventive Blending Examples—Blends Including Fatty Acid Alkyl Ester & Conventional Distillate Based on the ability of fatty acid alkyl esters to maintain or even improve compatibility in blends including a resid-containing fraction, fatty acid alkyl esters can also be used in combination with conventional distillate fractions. Using a mixture of fatty acid alkyl ester fraction(s) and conventional distillate fraction(s) as a flux for resid-containing fraction(s) can allow for greater flexibility when blending to form marine fuel products.

FIG. 5 shows a series of blends containing fuel oil, fatty acid methyl esters, and distillate fractions. FIG. 5 shows model blends formed from a combination of FO2 (from FIG. 2), FAME 5 (from FIG. 2), and either Distillate 4 or Renewable Diesel 1 (from FIG. 1). These blends maintain the same ratio of fuel oil to distillate flux as in Table 3. FIG. 5 also shows a series of model blends that were formed using a combination of FO3 (from FIG. 2), FAME 1 (from FIG. 2), and Distillate 1 (from FIG. 1). The compatibility characteristics for the model blends shown in FIG. 5 were based on calculation of compatibility characteristics based on ideal blending, where BMCI and $S_{BN}$ values are based on weighted averages of the blend components while TE and $I_N$ values are based on the corresponding value for FO3.

As shown in FIG. 5, the BMCI−TE values for all of the blends are below 15, indicating that under conventional blending, all of the blends would be considered to have too high of a potential for sediment formation. However, as shown by the $S_{BN}$−$I_N$ difference values, adding sufficient amounts of fatty acid alkyl ester can overcome the compatibility issues that are created by adding the distillate flux. As a result, blends including up to 70 vol % (or more) of combined fatty acid alkyl ester and distillate flux can be added to a resid-containing fraction while still reducing or minimizing sediment formation to acceptable levels. Additional modeled blends with conventional distillate flux that have similar blend properties are shown in FIG. 13. Hand blends were also created for the two blends with FO2 in FIG. 5, and partial data is shown in FIG. 13. Both blends had performance consistent with that predicted in FIG. 5, with TSP<0.01 wt %. Comparison of the FO2 blends with the blends in Table 3 also shows that the addition of fatty acid alkyl ester can stabilize unstable blends of fuel oil and distillate flux.

Additional Comparative Blending Examples—Aryl Ester as a Blend Component

The unexpected benefits of using fatty acid alkyl esters as a blend component with resid-containing fractions were not observed with other types of esters. Table 5 shows examples of blending an aryl ester, phenethyl octanoate, with a resid-containing fraction (FO5). In the example shown in Table 5, the resid-containing fraction is already prone to sediment formation. This is indicated by both the BMCI−TE value of 7.5, and confirmed by the measured sediment value of 0.49 wt %. The aryl ester fraction had a BMCI value of 83, which is greater than the BMCI value of 73.5 for FO2.

As shown in Table 5, the aryl ester did not provide the unexpected benefits of the fatty acid alkyl ester fractions. Although the BMCI value of the aryl ester was greater than the BMCI value of FO5, each of the blends shown in Table 5 has a higher measured sediment value than the measured sediment for the neat FO5. This indicates that the addition of the aryl ester decreased the compatibility of the blend, as opposed to the addition of the fatty acid alkyl esters, which appeared to increase the compatibility of the blend. It is believed that the reduction in sediment amount as the amount of aryl ester is increased is due in part to dilution.

TABLE 5

| Blends with Aryl Ester | | | | | | | |
|---|---|---|---|---|---|---|---|
| Test | Method | Unit | FO5 | PEO | 96% FO5 + 4% PEO | 83% FO5 + 17% PEO | 66% FO5 + 34% PEO |
| Density @ 15° C. | D4052 | g/cm$^3$ | 0.986 | 0.958 | 0.985 | 0.981 | 0.977 |
| Kinematic Viscosity (KV) @ 50° C. | D445 | mm$^2$/s | 247.40 | | | | |
| CCAI | Calculated | — | 852 | | | | |
| Distillation - Average Boiling Point | D86 | ° C. | | 295 | | | |
| BMCI | Calculated | — | 73.5 | 83.0 | 73.8 | 75.1 | 76.7 |
| Toluene Equivalence (TE) | AM-S 79-004 | — | 66 | 0 | 66 | 71 | 73 |
| BMCI − TE | — | — | 7.5 | 83.0 | 7.8 | 9.1 | 10.7 |
| Total Sediment Existent (TSE) | ISO 10307-1 | wt % | 0.49 | | 0.95 | 0.81 | 0.70 |

Example of Operation of a Marine Vessel on a Blend Containing 49 vol % Fatty Acid Alkyl Ester The effect of fatty acid methyl ester on marine vessel exhaust gases was evaluated, particularly the level of NOx emissions and visually observable particulate matter emissions in marine vessel exhaust gases. Two fuels were assessed: (1) a blend containing residual fuel oil and fatty acid methyl ester, and (2) a comparative fuel oil. The comparative fuel oil was a conventional marine residual fuel oil. Both fuels were both consumed in two engines on a marine vessel.

Table 6 shows the properties of blend components and the fuel blends used to operate two engines on the marine vessel. Components fuel oil 6 (FO6) and fatty acid alkyl ester 6 (FAME6) were combined at concentrations of 51% and 49% respectively to make a blended fuel. The properties of the blended fuel containing FO6 and FAME6 are generally consistent with the requirements of ISO 8217 Table 2 RMB, though the fuel could also potentially meet the requirements according to the RMD, RME, RMG, or RMK grades in Table 2. Fuel Oil 7 (FO7) is the comparative fuel used in the study. The properties of FO7 are generally consistent with the requirements of ISO 8217 Table 2 RMG380 grade, though the fuel could also potentially meet the requirements according to the RMG500, RMG700, or RMK grades in Table 2. During vessel operation NOx emissions were measured in the exhaust gases at multiple time points and the resulting multiple data points were averaged to give an Average NOx Emissions. It was unexpectedly found that operation on the blend containing fatty acid methyl ester (51% FO6+49% FAME6) resulted in a reduction in NOx emissions of approximately 17% for both Engine 1 and Engine 2, compared to operation on the conventional fuel oil FO7. Additionally, personnel on the marine vessel assessed visible particulate matter (PM) in exhaust gases by eye and by standard digital photography methods. Particulate matter emissions in exhaust gases were visually observable using an unaided human eye while operating on FO7. Particulate matter emissions in exhaust gases were not visually observable while the marine engines were operating on the blending containing FO6 and FAME6.

TABLE 6

| Properties of Components and Final Blend | | | | | | |
|---|---|---|---|---|---|---|
| | Method | Unit | FO6 | FAME6 | 51% FO6 + 49% FAME6 | FO7 |
| Density @ 15° C. | ISO 12185 | kg/m$^3$ | 962.5 | 874.2 | 921.5 | 985.5 |
| Kinematic Viscosity (KV) @ 40° C. | ISO 3104 | mm2/s | — | 4.385 | 18.81 | — |
| Kinematic Viscosity (KV) @ 50° C. | ISO 3104 | mm2/s | 154.8 | 3.57± | 13.48 | 312.2 |
| CCAI | Calculated | — | 833 | — | 832 | 848 |
| Cetane Number, generic | IP 617 | — | — | 59.3 | — | — |
| Sulfur | ISO 8754 | mass % | 0.4710 | — | 0.25 | 1.48 |
| | ISO 20846 | mg/kg | — | 3 | | — |
| Carbon Residue | ISO 10370 | mass % | 5.78 | 0± | 2.67 | 11.26 |
| Total Sediment | ISO 10307-2 | mass % | | | | |
| Accelerated, Procedure A (Thermal) | | | <0.01 | — | <0.01 | — |
| Procedure B (Chemical) | | | — | — | — | 0.02 |
| BMCI | Calculated | — | 63± | 37± | 50± | 72± |

TABLE 6-continued

Properties of Components and Final Blend

| | Method | Unit | FO6 | FAME6 | 51% FO6 + 49% FAME6 | FO7 |
|---|---|---|---|---|---|---|
| TE | AM-S | — | 37 | 0± | 37± | — |
| | 79-004 | — | | | | |
| BMCI – TE | Calculated | — | 26 | 0± | 13± | — |
| Asphaltene Content | IP 143 | mass % | 1.9 | 0± | 1± | — |
| Pour Point | ISO 3016 | ° C. | 0 | 12 | <0 | <24 |
| Estimated Cetane Number (ECN) | IP 541 | — | — | — | 44.8 | — |
| Average NOx Emissions | Gas analyzer | ppm | | | | |
| Engine 1 | | | — | — | 1044 | 1253 |
| Engine 2 | | | — | — | 525 | 631 |
| Visible PM in Exhaust Gases | — | — | — | — | No | Yes |

±Estimated

Water Affinity and Microbiological Growth of Blends Containing Fatty Acid Methyl Ester The water affinity and susceptibility to microbiological growth were compared for neat residual fuel and blends containing fatty acid methyl ester. The residual fuel used was similar in properties to FO3 and FO4 (FIG. 2), and the fatty acid methyl ester was similar in properties to FAME1 (FIG. 2), producing blends similar to those in FIG. 3 and FIG. 4. The fuel oil was blended in 80/20 and 50/50 volume ratios with the fatty acid methyl ester. FIG. 6 shows the water affinity performance assessed for each fuel mixed with sterile water at 1000:1, 500:1, 100:1, and 10:1 ratios. As expected, the measured water content was slightly higher in the dead bottom samples than in the upper, middle, and lower samples for all fuel blends. Similar behavior was observed for all fuel blends at the 1000:1 fuel to water ratio. At higher water ratios, blends with fatty acid methyl ester had lower measured water content compared to the neat residual fuel, and the blend with 50 vol % fatty acid methyl ester had either similar or lower water than the blend with 20 vol % fatty acid methyl ester. These results suggest that fatty acid methyl ester does not increase water affinity when blended into residual fuel oil.

The fuel-water mixtures were then seeded with bacteria, yeast, mold, and sulfur-reducing bacteria taken from spoiled fuel samples, and growth was observed over four weeks. FIG. 7 shows the microbial growth measured in the fuel phase for each fuel blend at each water ratio and at upper, middle, lower, and dead bottom sample locations. FIG. 8 shows the microbial growth measured in the water layer by microbe type for each fuel blend and water ratio at which growth was detected (no growth was observed at the 500:1 fuel to water ratio). FIG. 9 shows the microbial growth measured in suspended water droplets (separated from the fuel by centrifugation) by microbe type for each fuel blend at each water ratio. As shown in FIG. 7, higher water to fuel ratios and blends with fatty acid methyl ester generally produced more growth in the fuel phase, but the level of microbial growth was low for all samples. The microbial load found in the water layer and the suspended water droplets was similarly low for all fuels and water ratios. These results suggest that neat residual fuel and blends of residual fuel with fatty acid methyl have a similar susceptibility to microbial growth.

Calculation of Life Cycle Carbon Intensity Reduction

As shown in FIG. 10, the following example illustrates reducing life cycle GHG emissions ("carbon intensity") by including renewable blend components in a marine fuel blend, such as fatty acid methyl ester, or fatty acid methyl ester in combination with hydrotreated vegetable oil. The five blend components utilized in this example are as follows.

Blend Component 1 is a conventional resid-containing fraction. The life cycle GHG emissions factor for heavy fuel oil (HFO) in EN 16258 Table A.1 (3.31 $kgCO_2eq$/liter) is used to represent the life cycle GHG emissions per liter of Blend Component 1.

Blend Component 2 is a conventional distillate fraction, used in this example as a secondary flux for a marine fuel composition. The life cycle GHG emissions factor for diesel in EN 16258 Table A.1 (3.24 $kgCO_2eq$/liter) is used to represent the life cycle GHG emissions per liter of Blend Component 2.

Blend Component 3 is a fatty acid methyl ester fraction, specifically, a fatty acid methyl ester manufactured from waste-based feedstocks such as used cooking oil or beef tallow. The life cycle GHG emissions per liter of Blend Component 3 is calculated based on: (1) the default GHG emission savings for waste vegetable or animal oil biodiesel in Directive 2009/30/EC of the European Parliament and of the Council, Annex IV, Part A, which is 83%, and (2) as the baseline for calculating savings, the fossil fuel comparator provided in Directive 2009/30/EC of the European Parliament and of the Council, Annex IV, Part C, which is 83.8 g $CO_2eq$ emissions per MJ (energy basis), and (3) to convert from MJ (energy basis) to liters (volume basis), the energy density of fatty acid methyl ester taken from Directive 2009/30/EC of the European Parliament and of the Council, which is 33 MJ/liter. By using these three values, the life cycle GHG emissions factor of Blend Component 3 is calculated to be 14.2 $gCO_2eq$/MJ (energy basis) and then converted to 470 $gCO_2eq$/liter (volume basis), which can also be represented as 0.47 $kgCO_2eq$/liter (volume basis).

Blend Component 4 is a fatty acid methyl ester fraction, specifically, a fatty acid methyl ester manufactured from waste-based feedstocks such as used cooking oil or beef tallow. The life cycle GHG emissions per liter of Blend Component 4 is calculated based on (1) the typical GHG emission savings for waste vegetable or animal oil biodiesel in Directive 2009/30/EC of the European Parliament and of the Council, Annex IV, Part A, which is 88%, and (2) as the baseline for calculating savings, the fossil fuel comparator provided in Directive 2009/30/EC of the European Parliament and of the Council, Annex IV, Part C, which is 83.8 g $CO_2eq$ emissions per MJ (energy basis), and (3) to convert from MJ (energy basis) to liters (volume basis), the energy density of fatty acid methyl ester taken from Directive 2009/28/EC of the European Parliament and of the Council, Annex III, which is 33 MJ/liter. By using these three values, the life cycle GHG emissions factor of Blend Component 4 is calculated to be 10.1 $gCO_2eq$/MJ (energy basis) and then converted to 332 $gCO_2eq$/liter (volume basis), which can also be represented as 0.332 $kgCO_2eq$/liter (volume basis).

Blend Component 5 is a hydrotreated vegetable oil. The life cycle GHG emissions per liter of Blend Component 5 is calculated based on (1) the typical GHG emission savings for hydrotreated vegetable oil from rape seed in Directive 2009/30/EC of the European Parliament and of the Council, Annex IV, Part A, which is 51%, and (2) as the baseline for calculating savings, the fossil fuel comparator provided in Directive 2009/30/EC of the European Parliament and of the Council, Annex IV, Part C, which is 83.8 g $CO_2eq$ emissions per MJ (energy basis), and (3) to convert from MJ (energy basis) to liters (volume basis), the energy density of hydrotreated vegetable oil taken from Directive 2009/28/EC of the European Parliament and of the Council, Annex III, which is 34 MJ/liter. By using these three values, the life cycle GHG emissions factor of Blend Component 5 is calculated to be 41.1 $gCO_2eq$/MJ (energy basis) and then converted to 1396 $gCO_2eq$/liter (volume basis), which can also be represented as 1.396 $kgCO_2eq$/liter (volume basis).

This example further comprises six fuel compositions which are created from the above blend components, alone or in combination. To facilitate comparison of life cycle GHG emissions reduction ("carbon intensity"), combustion of a fuel volume of 1000 $m^3$ (1000000 liter) in an engine is assumed for each fuel composition.

Fuel 1 is a fuel composition comprising a conventional resid-containing fraction (Blend Component 1). The life cycle GHG emissions factor for heavy fuel oil (HFO) in EN 16258 Table A.1 (3.31 $kgCO_2eq$/liter) represents the life cycle GHG emissions per liter of Fuel 1. For Fuel 1, life cycle GHG emissions ("carbon intensity") associated with combustion of a 1000 $m^3$ (1000000 liter) volume of fuel in an engine is calculated to be 3310000 $kgCO_2eq$.

Fuel 2 is a fuel composition comprising a conventional resid-containing fraction (Blend Component 1, 80 vol %) which further contains a renewable blending component, specifically, a fatty acid methyl ester (Blend Component 3, 20 vol %). The life cycle GHG emissions per liter of Fuel 2 can be calculated as a weighted average (by vol %) of the life cycle GHG emissions per liter of Blend Component 1 and Blend Component 3, and is calculated to be 2.742 $kgCO_2eq$/liter. For Fuel 2, life cycle GHG emissions ("carbon intensity") associated with combustion of a 1000 $m^3$ (1000000 liter) volume of fuel in an engine is calculated to be 2742000 $kgCO_2eq$. Compared to Fuel 1, this represents a reduction of 17% on a volume basis.

Fuel 3 is a fuel composition comprising a conventional resid-containing fraction (Blend Component 1, 30 vol %) which further contains a conventional distillate fraction (Blend Component 2, 30 vol %) and a renewable blending component, specifically, a fatty acid methyl ester (Blend Component 3, 40 vol %). Overall, the conventional fraction represents 60 vol % of this fuel composition, and the renewable fraction 40 vol %. The life cycle GHG emissions per liter of Fuel 3 can be calculated as a weighted average (by vol %) of the life cycle GHG emissions per liter of Blend Component 1, Blend Component 2, and Blend Component 3, and is calculated to be 2.0978 $kgCO_2eq$/liter. For Fuel 3, life cycle GHG emissions ("carbon intensity") associated with combustion of a 1000 $m^3$ (1000000 liter) volume of fuel in an engine is calculated to be 2097800 $kgCO_2eq$. Compared to Fuel 1, this represents a reduction of 37% on a volume basis.

Fuel 4 is a fuel composition comprising a conventional resid-containing fraction (Blend Component 1, 50 vol %) which further contains a renewable blending component, specifically, a fatty acid methyl ester (Blend Component 4, 50 vol %). The life cycle GHG emissions per liter of Fuel 4 can be calculated as a weighted average (by vol %) of the life cycle GHG emissions per liter of Blend Component 1 and Blend Component 4, and is calculated to be 1.821 $kgCO_2eq$/liter. For Fuel 4, life cycle GHG emissions ("carbon intensity") associated with combustion of a 1000 $m^3$ (1000000 liter) volume of fuel in an engine is calculated to be 1821000 $kgCO_2eq$. Compared to Fuel 1, this represents a reduction of 45% on a volume basis.

Fuel 5 is a fuel composition comprising a conventional resid-containing fraction (Blend Component 1, 40 vol %) which further contains a renewable fraction, containing a hydrotreated vegetable oil (Blend Component 5, 20 vol %) and a fatty acid methyl ester (Blend Component 3, 40 vol %). Overall, the conventional fraction represents 40 vol % of this fuel composition, and the renewable fraction 60 vol %. The life cycle GHG emissions per liter of Fuel 5 can be calculated as a weighted average (by vol %) of the life cycle GHG emissions per liter of Blend Component 1, Blend Component 5, and Blend Component 3, and is calculated to be 1.736 $kgCO_2eq$/liter. For Fuel 5, life cycle GHG emissions ("carbon intensity") associated with combustion of a 1000 $m^3$ (1000000 liter) volume of fuel in an engine is calculated to be 1736000 $kgCO_2eq$. Compared to Fuel 1, this represents a reduction of 48% on a volume basis.

Fuel 6 is a fuel composition comprising a conventional resid-containing fraction (Blend Component 1, 30 vol %) which further contains a renewable blending component, specifically, a fatty acid methyl ester (Blend Component 4, 70 vol %). The life cycle GHG emissions per liter of Fuel 6 can be calculated as a weighted average (by vol %) of the life cycle GHG emissions per liter of Blend Component 1 and Blend Component 4, and is calculated to be 1.2254 $kgCO_2eq$/liter. For Fuel 6, life cycle GHG emissions ("carbon intensity") associated with combustion of a 1000 $m^3$ (1000000 liter) volume of fuel in an engine is calculated to be 1225400 $kgCO_2eq$. Compared to Fuel 1, this represents a reduction of 63% on a volume basis.

Calculation of life cycle carbon intensity reduction for the two fuels used to operate marine vessel engines in a prior example, FO7 and a blend of 51 vol % FO6 and 49 vol % FAME6, is illustrated in FIG. 11. For the purpose of this example, the blend of 51 vol % FO6 and 49 vol % FAME6 will be referred to as Fuel 7.

FO6 is a resid-containing fraction. The life cycle GHG emissions factor for heavy fuel oil (HFO) in EN 16258 Table A.1 (3.31 $kgCO_2eq$/liter) is used to represent the life cycle GHG emissions per liter of FO6.

FAME6 is a fatty acid methyl ester fraction, specifically, a fatty acid methyl ester manufactured from waste-based feedstocks such as used cooking oil or beef tallow. The life cycle GHG emissions per liter of FAME6 was calculated based on (1) the calculated GHG emission savings for this specific fatty acid methyl ester fraction, determined according to the methodology in Directive 2009/30/EC of the European Parliament and of the Council, Annex IV, Part C, which is 89.4%, and (2) as the baseline for calculating savings, the fossil fuel comparator provided in Directive 2009/30/EC of the European Parliament and of the Council, Annex IV, Part C, which is 83.8 $gCO_2eq$ GHG emissions per MJ (energy basis), and (3) to convert from MJ (energy basis) to liters (volume basis), the energy density of fatty acid methyl ester taken from Directive 2009/28/EC of the European Parliament and of the Council, Annex III, which is 33 MJ/liter. By using these three values, the life cycle GHG emissions factor of Blend Component 4 is calculated to be 8.89 $gCO_2eq$/MJ (energy basis) and then converted to 293 $gCO_2eq$/liter (volume basis), which can also be represented as 0.293 $kgCO_2eq$/liter (volume basis).

FO7 is a residual marine fuel oil containing only conventional fuel blend components. The life cycle GHG emissions factor for heavy fuel oil (HFO) in EN 16258 Table A.1 (3.31 $kgCO_2eq$/liter) is used to represent the life cycle GHG emissions per liter of FO7. Fuel 1 is a fuel composition comprising a conventional resid-containing fraction (Blend Component 1). For FO7, life cycle GHG emissions ("carbon intensity") associated with combustion of a 1000 $m^3$ (1000000 liter) volume of fuel in an engine is calculated to be 3310000 $kgCO_2eq$. FO7 is the baseline used to determine life cycle GHG emissions savings.

Fuel 7 is a fuel composition comprising a conventional resid-containing fraction (FO6, 51 vol %) which further contains a renewable blending component, specifically, a waste-based fatty acid methyl ester (FAME6, 49 vol %). The life cycle GHG emissions per liter of Fuel 7 can be calculated as a weighted average (by vol %) of the life cycle GHG emissions per liter of FO6 and FAME6, and is calculated to be 1.83 $kgCO_2eq$/liter. For Fuel 7, life cycle GHG emissions ("carbon intensity") associated with combustion of a 1000 $m^3$ (1000000 liter) volume of fuel in an engine is calculated to be 1831670 $kgCO_2eq$. Compared to FO7, this represents a reduction of 45% on a volume basis.

PCT/EP Clauses:

1. A marine fuel or fuel blending composition comprising: at least 20 vol % of a resid-containing fraction, and from 5 vol % to 80 vol % of one or more renewable fuel blending components, wherein the one or more renewable fuel blending components includes one or more fatty acid alkyl esters.

2. The marine fuel or fuel blending composition of clause 1 comprising from 5 vol % to 70 vol % of the one or more fatty acid alkyl esters based on the total marine fuel or fuel blending composition.

3. The marine fuel or fuel blending composition of clause 2 comprising from 10 vol % to 55 vol % of the one or more fatty acid alkyl esters.

4. The marine fuel or fuel blending composition of clauses 1-3, wherein the one or more fatty acid alkyl esters comprise a BMCI of 50 or less and a $S_{BN}$ of 55 or more.

5. The marine fuel or fuel blending composition of clauses 1-4, wherein the one or more renewable fuel blending components further include gas-to-liquid hydrocarbons from renewable synthesis gas, hydrotreated natural fat or oil, hydrotreated waste cooking oil, hydrotreated tall oil, pyrolysis gas oil, or combinations thereof.

6. The marine fuel or fuel blending composition of clause 5, wherein the gas-to-liquid hydrocarbons from renewable synthesis gas, the hydrotreated natural fat or oil, the hydrotreated waste cooking oil, the hydrotreated tall oil, the pyrolysis gas oil, or the combinations thereof comprise from 1 vol % to 50 vol. % of the total marine fuel or fuel blending composition.

7. The marine fuel or fuel blending composition of clauses 1-6, wherein the one or more renewable fuel blending components boil within a distillate range of from 150° C. and 400° C.

8. The marine fuel or fuel blending composition of clauses 1-7 further including a conventional distillate flux selected from the group consisting of a diesel component, a gas oil component, a kerosene component, a cycle oil component, a gas-to-liquid component, and combinations thereof.

9. The marine fuel or fuel blending composition of clause 8, wherein the conventional distillate flux comprises from 1 vol % to 30 vol. % of the total marine fuel or fuel blending composition.

10. The marine fuel or fuel blending composition of clauses 1-9 further including one or more oxygenates at from 0.1 vol % to 20 vol. % of the total marine fuel or fuel blending composition.

11. The marine fuel or fuel blending composition of clauses 1-10 further including one or more fuel additives selected from the group consisting of pour point improver, combustion improver, flocculant, dispersant, $H_2S$ scavenger, antioxidant, stability improver, compatibility improver, and combinations thereof.

12. The marine fuel or fuel blending composition of clause 11, wherein the one or more fuel additives comprise from 5 vppm to 1 vol % of the total marine fuel or fuel blending composition.

13. The marine fuel or fuel blending composition of clauses 1-12, wherein the resid-containing fraction is selected from the group consisting of a vacuum resid fraction, an atmospheric resid fraction, main column bottoms, steam cracker tar, visbreaker tar, a residue material derived from low sulfur crude slates (ULSFO, VLSFO, LSFO, RSFO, or blends thereof) and combinations thereof.

14. The marine fuel or fuel blending composition of clauses 1-13, wherein the resid-containing fraction is hydrotreated.

15. The marine fuel or fuel blending composition of clauses 1-14 comprising one or more of the following fuel properties: a sulfur content of between 500 wppm to 5000 wppm, a kinematic viscosity at 50° C. between 5 to 380 cSt, and a micro carbon residue of 0.5 wt % or more, and a sediment content of 0.1 wt % or less according to ISO 10307-2 Procedure A or B.

16. The marine fuel or fuel blending composition of claim 1 comprising a carbon intensity reduction on a life cycle basis of at least 10% compared to a comparable marine fuel or fuel blending composition not including the one or more renewable fuel blending components according to the methodology in Directive 2009/30/EC of the European Parliament and of the Council.

17. The marine fuel or fuel blending composition of clauses 1-16, wherein the resid-containing fraction comprises a BMCI–TE difference value of 50 or less, or wherein the marine fuel or fuel blending composition comprises a BMCI–TE difference value of 15 or less, or a combination thereof.

18. The marine fuel or fuel blending composition of clauses 1-17, wherein the $S_{BN}$ of the one or more fatty acid alkyl esters is greater than a $S_{BN}$ of the resid-containing fraction, or wherein the one or more fatty acid alkyl esters comprise one or more fatty acid methyl esters, or a combination thereof.

19. The marine fuel or fuel blending composition of clause 9, wherein the conventional distillate flux comprises a BMCI of 40 or less and a $S_{BN}$ of 50 or less.

20. The marine fuel or fuel blending composition of clauses 1-19, wherein the resid-containing fraction comprises a $S_{BN}$–$I_N$ difference value of 40 or less, or wherein the marine fuel or fuel blending composition comprises a $S_{BN}$–$I_N$ difference value of 20 or more, or a combination thereof.

21. The marine fuel or fuel blending composition of clauses 1-20, wherein the resid-containing fraction comprises a kinematic viscosity at 50° C. of 30 cSt or more, or wherein the resid-containing fraction comprises a density at 15° C. of 0.95 g/cm$^3$ or more, or a combination thereof.

22. The marine fuel or fuel blending composition of clauses 1-21, wherein the resid-containing fraction has a $T_{90}$ distillation point of 550° C. or more, or wherein the resid-containing fraction comprises 5.0 wt % or more of micro carbon residue, or a combination thereof.

23. The marine fuel or fuel blending composition of clauses 1-22, wherein the marine fuel or fuel blending composition comprises a kinematic viscosity at 50° C. of 380 cSt or less, or wherein the marine fuel or fuel blending composition comprises a kinematic viscosity at 50° C. of 60 cSt or less.

24. The marine fuel or fuel blending composition of clauses 1-23, wherein the marine fuel or fuel blending composition comprises a sediment level of 0.1 wt % or less, or wherein the marine fuel or fuel blending composition comprises 5000 wppm or less of sulfur, or a combination thereof.

25. A method of making a marine fuel or fuel blending composition according to any of clauses 1 to 24, comprising: providing a resid-containing fraction and one or more renewable fuel blending components, blending at least 20 vol % of the resid-containing fraction with from 5 vol % to 80 vol % of the one or more renewable fuel blending components to form a marine fuel or fuel blending composition, wherein the one or more renewable fuel blending components includes one or more fatty acid alkyl esters.

26. A method of reducing the life cycle carbon intensity of a marine fuel or a fuel blending composition according to any of clauses 1 to 24, comprising: providing a resid-containing fraction and one or more renewable fuel blending components, blending at least 20 vol % of the resid-containing fraction with from 5 vol % to 80 vol % of the one or more renewable fuel blending components to form a marine fuel or fuel blending composition, calculating the carbon intensity reduction on a life cycle basis of the marine fuel or fuel blending composition compared to a comparable marine fuel or fuel blending composition not including the one or more renewable fuel blending components according to the methodology in Directive 2009/30/EC of the European Parliament and of the Council, wherein the one or more renewable fuel blending components includes one or more fatty acid alkyl esters, and wherein the carbon intensity reduction on a life cycle basis of the marine fuel or fuel blending composition is at least 10% lower than a comparable marine fuel or fuel blending composition not including the one or more renewable fuel blending components.

While the present invention has been described and illustrated by reference to particular embodiments, those of ordinary skill in the art will appreciate that the invention lends itself to variations not necessarily illustrated herein. Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated.

What is claimed is:

1. A marine fuel or fuel blending composition comprising: at least 20 vol % of a resid-containing fraction, and from 5 vol % to 80 vol % of one or more renewable fuel blending components, wherein the one or more renewable fuel blending components includes one or more fatty acid alkyl esters.

2. The marine fuel or fuel blending composition of claim 1 comprising from 5 vol % to 70 vol % of the one or more fatty acid alkyl esters based on the total marine fuel or fuel blending composition.

3. The marine fuel or fuel blending composition of claim 2 comprising from 10 vol % to 55 vol % of the one or more fatty acid alkyl esters.

4. The marine fuel or fuel blending composition of claim 1, wherein the one or more renewable fuel blending components further include gas-to-liquid hydrocarbons from renewable synthesis gas, hydrotreated natural fat or oil, hydrotreated waste cooking oil, hydrotreated tall oil, pyrolysis gas oil, or combinations thereof at from 1 vol % to 50 vol. % of the total marine fuel or fuel blending composition.

5. The marine fuel or fuel blending composition of claim 1, wherein the one or more renewable fuel blending components boil within a distillate range of from 150° C. and 400° C.

6. The marine fuel or fuel blending composition of claim 1, a) further including a conventional distillate flux selected from the group consisting of a diesel component, a gas oil component, a kerosene component, a cycle oil component, a gas-to-liquid component, and combinations thereof at from 1 vol % to 30 vol. % of the total marine fuel or fuel blending composition; b) further including one or more oxygenates at from 0.1 vol % to 20 vol % of the total marine fuel or fuel blending composition; or c) a combination of a) and b).

7. The marine fuel or fuel blending composition of claim 1 comprising one or more of the following fuel properties: a sulfur content of between 500 wppm to 5000 wppm, a kinematic viscosity at 50° C. between 5 to 380 cSt, and a micro carbon residue of 0.5 wt % or more, and a sediment content of 0.1 wt % or less according to ISO 10307-2 Procedure A or B.

8. The marine fuel or fuel blending composition of claim 1 comprising a carbon intensity reduction on a life cycle basis of at least 10% compared to a comparable marine fuel or fuel blending composition not including the one or more renewable fuel blending components according to the methodology in Directive 2009/30/EC of the European Parliament and of the Council.

9. The marine fuel or fuel blending composition of claim 1, wherein the $S_{BN}$ of the one or more fatty acid alkyl esters is greater than a $S_{BN}$ of the resid-containing fraction, or wherein the one or more fatty acid alkyl esters comprise one or more fatty acid methyl esters, or a combination thereof.

10. The marine fuel or fuel blending composition of claim 6, wherein the conventional distillate flux comprises a BMCI of 40 or less and a $S_{BN}$ of 50 or less.

11. A method of making a marine fuel or fuel blending composition, comprising:

providing a resid-containing fraction and one or more renewable fuel blending components, blending at least 20 vol % of the resid-containing fraction with from 5 vol % to 80 vol % of the one or more renewable fuel blending components to form a marine fuel or fuel blending composition, wherein the one or more renewable fuel blending components includes one or more fatty acid alkyl esters.

12. The method of claim 11 comprising from 5 vol % to 70 vol % of the one or more fatty acid alkyl esters based on the total marine fuel or fuel blending composition.

13. The method of claim 11, wherein the one or more renewable fuel blending components further includes gas-to-liquid hydrocarbons from renewable synthesis gas, hydrotreated natural fat or oil, hydrotreated waste cooking oil, hydrotreated tall oil, pyrolysis gas oil, or combinations thereof at from 5 vol % to 50 vol. % of the total marine fuel or fuel blending composition.

14. The method of claim 11, wherein the one or more renewable fuel blending components boil within a distillate range of from 150° C. and 400° C.

15. The method of claim 11, a) further including blending a conventional distillate flux into the marine fuel or fuel blending composition, wherein the conventional distillate flux is selected from the group consisting of a diesel component, a gas oil component, a kerosene component, a cycle oil component, a gas-to-liquid component, and combinations thereof at from 1 vol % to 30 vol. % of the total marine fuel or fuel blending composition; b) further including blending one or more oxygenates into the marine fuel or fuel blending composition, wherein the one or more oxygenates comprise from 0.1 vol % to 20 vol % of the total marine fuel or fuel blending composition; or c) a combination of a) and b).

16. The method of claim 11, wherein the marine fuel or fuel blending composition comprises one or more of the following fuel properties: a sulfur content of between 500 wppm to 5000 wppm, a kinematic viscosity at 50° C. between 5 to 380 cSt, and a micro carbon residue of 0.5 wt % or more, and a sediment content of 0.1 wt % or less according to ISO 10307-2 Procedure A or B.

17. The method of claim 11, wherein the marine fuel or fuel blending composition comprises a carbon intensity reduction on a life cycle basis of at least 10% compared to a comparable marine fuel or fuel blending composition not including the one or more renewable fuel blending components according to the methodology in Directive 2009/30/EC of the European Parliament and of the Council.

18. The method of claim 11, wherein the $S_{BN}$ of the one or more fatty acid alkyl esters is greater than a $S_{BN}$ of the resid-containing fraction, or wherein the one or more fatty acid alkyl esters comprise one or more fatty acid methyl esters, or a combination thereof.

19. The method of claim 15, wherein the conventional distillate flux comprises a BMCI of 40 or less and a $S_{BN}$ of 50 or less.

20. A method of reducing the life cycle carbon intensity of a marine fuel or a fuel blending composition, comprising:

providing a resid-containing fraction and one or more renewable fuel blending components, blending at least 20 vol % of the resid-containing fraction with from 5 vol % to 80 vol % of the one or more renewable fuel blending components to form a marine fuel or fuel blending composition, calculating the carbon intensity reduction on a life cycle basis of the marine fuel or fuel blending composition compared to a comparable marine fuel or fuel blending composition not including the one or more renewable fuel blending components according to the methodology in Directive 2009/30/EC of the European Parliament and of the Council, wherein the one or more renewable fuel blending components includes one or more fatty acid alkyl esters, and wherein the carbon intensity reduction on a life cycle basis of the marine fuel or fuel blending composition is at least 10% lower than a comparable marine fuel or fuel blending composition not including the one or more renewable fuel blending components.

21. The method of claim 20 comprising from 5 vol % to 70 vol % of the one or more fatty acid alkyl esters based on the total marine fuel or fuel blending composition.

22. The method of claim 20, wherein the one or more renewable fuel blending components further includes gas-to-liquid hydrocarbons from renewable synthesis gas, hydrotreated natural fat or oil, hydrotreated waste cooking oil, hydrotreated tall oil, pyrolysis gas oil, or combinations thereof at from 1 vol % to 50 vol. % of the total marine fuel or fuel blending composition.

23. The method of claim 20, wherein the one or more renewable fuel blending components boil within a distillate range of from 150° C. and 400° C.

24. The method of claim 20, a) further including blending a conventional distillate flux into the marine fuel or fuel blending composition, wherein the conventional distillate flux is selected from the group consisting of a diesel component, a gas oil component, a kerosene component, a cycle oil component, a gas-to-liquid component, and combinations thereof at from 1 vol % to 30 vol. % of the total marine fuel or fuel blending composition; b) further including blending one or more oxygenates into the marine fuel or fuel blending composition, wherein the one or more oxygenates comprise from 0.1 vol % to 20 vol % of the total marine fuel or fuel blending composition; or c) a combination of a) and b).

25. The method of claim 20, wherein the marine fuel or fuel blending composition comprises one or more of the following fuel properties: a sulfur content of between 500 wppm to 5000 wppm, a kinematic viscosity at 50° C. between 5 to 380 cSt, and a micro carbon residue of 0.5 wt % or more, and a sediment content of 0.1 wt % or less according to ISO 10307-2 Procedure A or B.

26. The method of claim 20, wherein the $S_{BN}$ of the one or more fatty acid alkyl esters is greater than a $S_{BN}$ of the resid-containing fraction, or wherein the one or more fatty acid alkyl esters comprise one or more fatty acid methyl esters, or a combination thereof.

27. The method of claim 24, wherein the conventional distillate flux comprises a BMCI of 40 or less and a $S_{BN}$ of 50 or less.

28. The marine fuel or fuel blending composition of claim 1, wherein the marine fuel or fuel blending composition comprises a micro carbon residue of 2 wt % or more.

29. The method of claim 11, wherein the marine fuel or fuel blending composition comprises a density at 15° C. of 0.89 g/cm$^3$ to 1.05 g/cm$^3$.

30. The method of claim 20, wherein the marine fuel or fuel blending composition comprises a micro carbon residue of 2 wt % or more.

* * * * *